US009153911B2

(12) United States Patent
Burris et al.

(10) Patent No.: US 9,153,911 B2
(45) Date of Patent: Oct. 6, 2015

(54) COAXIAL CABLE CONTINUITY CONNECTOR

(71) Applicants: Donald Andrew Burris, Peoria, AZ (US); William Bernard Lutz, Glendale, AZ (US)

(72) Inventors: Donald Andrew Burris, Peoria, AZ (US); William Bernard Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 55 days.

(21) Appl. No.: 13/827,522

(22) Filed: Mar. 14, 2013

(65) Prior Publication Data

US 2014/0235099 A1 Aug. 21, 2014

Related U.S. Application Data

(60) Provisional application No. 61/770,715, filed on Feb. 28, 2013, provisional application No. 61/766,436, filed on Feb. 19, 2013.

(51) Int. Cl.

| | |
|---|---|
| ***H01R 9/05*** | (2006.01) |
| ***H01R 13/6581*** | (2011.01) |
| ***H01R 24/38*** | (2011.01) |
| *H01R 103/00* | (2006.01) |

(52) U.S. Cl.

CPC ..... *H01R 13/6581* (2013.01); *H01R 9/0521* (2013.01); *H01R 24/38* (2013.01); *H01R 2103/00* (2013.01)

(58) Field of Classification Search

USPC ..... 439/578, 582–585, 92, 320–323

See application file for complete search history.

(56) References Cited

U.S. PATENT DOCUMENTS

| | | | |
|---|---|---|---|
| 331,169 | A | 11/1885 | Thomas |
| 346,958 | A | 8/1886 | Stone |
| 459,951 | A | 9/1891 | Warner |
| 589,216 | A | 8/1897 | McKee |
| 1,371,742 | A | 3/1921 | Dringman |
| 1,488,175 | A | 3/1924 | Strandell |
| 1,667,485 | A | 4/1928 | MacDonald |

(Continued)

FOREIGN PATENT DOCUMENTS

| | | |
|---|---|---|
| CA | 2096710 | 11/1994 |
| CN | 201149936 | 11/2008 |

(Continued)

OTHER PUBLICATIONS

Office Action dated Jun. 12, 2014 pertaining to U.S. Appl. No. 13/795,737.

(Continued)

*Primary Examiner* — Jean F Duverne

(57) ABSTRACT

A coaxial connector for coupling an end of a coaxial cable to an equipment appliance port or terminal is disclosed. The coaxial cable has an inner conductor, a dielectric surrounding the inner conductor, an outer conductor surrounding the dielectric, and a jacket surrounding the outer conductor is disclosed. The coaxial cable connector comprises a body, a coupler rotatably attached to the body, and a post secured to the body. The post has a structural feature. A grounding member is disposed between the post and the coupler in the structural feature. The grounding member establishes an electrical grounding path which may be maintained between coupler and post, including, when the coupler is not tightly fastened to a terminal and without restricting rotation of coupler relative to post.

37 Claims, 7 Drawing Sheets

(56) References Cited

U.S. PATENT DOCUMENTS 1,766,869 A 6/1930 Austin
1,801,999 A 4/1931 Bowman
1,885,761 A 11/1932 Peirce, Jr.
1,959,302 A 5/1934 Paige
2,013,526 A 9/1935 Schmitt
2,059,920 A 11/1936 Weatherhead, Jr.
2,102,495 A 12/1937 England
2,258,528 A 10/1941 Wurzburger
2,258,737 A 10/1941 Browne
2,325,549 A 7/1943 Ryzowitz
2,480,963 A 9/1949 Quinn
2,544,654 A 3/1951 Brown
2,549,647 A 4/1951 Turenne
2,694,187 A 11/1954 Nash
2,705,652 A 4/1955 Kaiser
2,754,487 A 7/1956 Carr et al.
2,755,331 A 7/1956 Melcher
2,757,351 A 7/1956 Klostermann
2,762,025 A 9/1956 Melcher
2,785,384 A 3/1957 Wickesser
2,805,399 A 9/1957 Leeper
2,816,949 A 12/1957 Curtiss
2,870,420 A 1/1959 Malek
2,878,039 A 3/1959 Hoegee et al.
2,881,406 A 4/1959 Arson
2,963,536 A 12/1960 Kokalas
3,001,169 A 9/1961 Blonder
3,015,794 A 1/1962 Kishbaugh
3,051,925 A 8/1962 Felts
3,091,748 A 5/1963 Takes et al.
3,094,364 A 6/1963 Lingg
3,103,548 A 9/1963 Concelman
3,106,548 A 10/1963 Lavalou
3,140,106 A 7/1964 Thomas et al.
3,184,706 A 5/1965 Atkins
3,194,292 A 7/1965 Borowsky
3,196,382 A 7/1965 Morello, Jr.
3,206,540 A 9/1965 Cohen
3,245,027 A 4/1966 Ziegler, Jr.
3,275,913 A 9/1966 Blanchard et al.
3,278,890 A 10/1966 Cooney
3,281,756 A 10/1966 O'Keefe et al.
3,281,757 A 10/1966 Bonhomme
3,290,069 A 12/1966 Davis
3,292,136 A 12/1966 Somerset
3,320,575 A 5/1967 Brown et al.
3,321,732 A 5/1967 Forney, Jr.
3,336,563 A 8/1967 Hyslop
3,348,186 A 10/1967 Rosen
3,350,667 A 10/1967 Shreve
3,350,677 A 10/1967 Daum
3,355,698 A 11/1967 Keller
3,372,364 A 3/1968 O'Keefe et al.
3,373,243 A 3/1968 Janowiak et al.
3,390,374 A 6/1968 Forney, Jr.
3,406,373 A 10/1968 Forney, Jr.
3,430,184 A 2/1969 Acord
3,448,430 A 6/1969 Kelly
3,453,376 A 7/1969 Ziegler, Jr. et al.
3,465,281 A 9/1969 Florer
3,475,545 A 10/1969 Stark et al.
3,494,400 A 2/1970 McCoy et al.
3,498,647 A 3/1970 Schroder
3,499,671 A 3/1970 Osborne
3,501,737 A 3/1970 Harris et al.
3,517,373 A 6/1970 Jamon
3,526,871 A 9/1970 Hobart
3,533,051 A 10/1970 Ziegler, Jr.
3,537,065 A 10/1970 Winston
3,544,705 A 12/1970 Winston
3,551,882 A 12/1970 O'Keefe
3,564,487 A 2/1971 Upstone et al.
3,587,033 A 6/1971 Brorein et al.
3,596,933 A 8/1971 Luckenbill
3,601,776 A 8/1971 Curl
3,603,912 A 9/1971 Kelly
3,614,711 A 10/1971 Anderson et al.
3,622,952 A 11/1971 Hilbert
3,629,792 A 12/1971 Dorrell
3,633,150 A 1/1972 Schwartz
3,646,502 A 2/1972 Hutter et al.
3,663,926 A 5/1972 Brandt
3,665,371 A 5/1972 Cripps
3,668,612 A 6/1972 Nepovim
3,669,472 A 6/1972 Nadsady
3,671,922 A 6/1972 Zerlin et al.
3,671,926 A 6/1972 Nepovim
3,678,444 A 7/1972 Stevens et al.
3,678,445 A 7/1972 Brancaleone
3,680,034 A 7/1972 Chow et al.
3,681,739 A 8/1972 Kornick
3,683,320 A 8/1972 Woods et al.
3,686,623 A 8/1972 Nijman
3,694,792 A 9/1972 Wallo
3,694,793 A 9/1972 Concelman
3,697,930 A 10/1972 Shirey
3,706,958 A 12/1972 Blanchenot
3,708,186 A 1/1973 Takagi et al.
3,710,005 A 1/1973 French
3,739,076 A 6/1973 Schwartz
3,744,007 A 7/1973 Horak
3,744,011 A 7/1973 Blanchenot
3,761,870 A 9/1973 Drezin et al.
3,778,535 A 12/1973 Forney, Jr.
3,781,762 A 12/1973 Quackenbush
3,781,898 A 12/1973 Holloway
3,783,178 A 1/1974 Philibert et al.
3,787,796 A 1/1974 Barr
3,793,610 A 2/1974 Brishka
3,798,589 A 3/1974 Deardurff
3,808,580 A 4/1974 Johnson
3,810,076 A 5/1974 Hutter
3,835,443 A 9/1974 Arnold et al.
3,836,700 A 9/1974 Niemeyer
3,845,453 A 10/1974 Hemmer
3,846,738 A 11/1974 Nepovim
3,854,003 A 12/1974 Duret
3,854,789 A 12/1974 Kaplan
3,858,156 A 12/1974 Zarro
3,879,102 A 4/1975 Horak
3,886,301 A 5/1975 Cronin et al.
3,907,335 A 9/1975 Burge et al.
3,907,399 A 9/1975 Spinner
3,910,673 A 10/1975 Stokes
3,915,539 A 10/1975 Collins
3,936,132 A 2/1976 Hutter
3,937,547 A 2/1976 Lee-Kemp
3,953,097 A 4/1976 Graham
3,960,428 A 6/1976 Naus et al.
3,963,320 A 6/1976 Spinner
3,963,321 A 6/1976 Burger et al.
3,970,355 A 7/1976 Pitschi
3,972,013 A 7/1976 Shapiro
3,976,352 A 8/1976 Spinner
3,980,805 A 9/1976 Lipari
3,985,418 A 10/1976 Spinner
3,986,736 A 10/1976 Takagi et al.
4,017,139 A 4/1977 Nelson
4,022,966 A 5/1977 Gajajiva
4,030,742 A 6/1977 Eidelberg et al.
4,030,798 A 6/1977 Paoli
4,032,177 A 6/1977 Anderson
4,045,706 A 8/1977 Daffner et al.
4,046,451 A 9/1977 Juds et al.
4,053,200 A 10/1977 Pugner
4,056,043 A 11/1977 Sriramamurty et al.
4,059,330 A 11/1977 Shirey
4,079,343 A 3/1978 Nijman
4,082,404 A 4/1978 Flatt
4,090,028 A 5/1978 Vontobel
4,093,335 A 6/1978 Schwartz et al.
4,100,943 A 7/1978 Terada et al.
4,106,839 A 8/1978 Cooper
4,109,126 A 8/1978 Halbeck

(56) References Cited

U.S. PATENT DOCUMENTS 4,125,308 A 11/1978 Schilling
4,126,372 A 11/1978 Hashimoto et al.
4,131,332 A 12/1978 Hogendobler et al.
4,136,897 A 1/1979 Haluch
4,150,250 A 4/1979 Lundeberg
4,153,320 A 5/1979 Townshend
4,156,554 A 5/1979 Aujla
4,165,911 A 8/1979 Laudig
4,168,921 A 9/1979 Blanchard
4,173,385 A 11/1979 Fenn et al.
4,174,875 A 11/1979 Wilson et al.
4,187,481 A 2/1980 Bourtos
4,193,655 A 3/1980 Herrmann, Jr.
4,194,338 A 3/1980 Trafton
4,206,963 A 6/1980 English et al.
4,212,487 A 7/1980 Jones et al.
4,225,162 A 9/1980 Dola
4,227,765 A 10/1980 Neumann et al.
4,229,714 A 10/1980 Yu
4,250,348 A 2/1981 Kitagawa
4,273,405 A 6/1981 Law
4,280,749 A 7/1981 Hemmer
4,285,564 A 8/1981 Spinner
4,290,663 A 9/1981 Fowler et al.
4,296,986 A 10/1981 Herrmann, Jr.
4,307,926 A 12/1981 Smith
4,309,050 A 1/1982 Legris
4,310,211 A 1/1982 Bunnell et al.
4,322,121 A 3/1982 Riches et al.
4,326,769 A 4/1982 Dorsey et al.
4,334,730 A 6/1982 Colwell et al.
4,339,166 A 7/1982 Dayton
4,346,958 A 8/1982 Blanchard
4,354,721 A 10/1982 Luzzi
4,358,174 A 11/1982 Dreyer
4,373,767 A 2/1983 Cairns
4,389,081 A 6/1983 Gallusser et al.
4,400,050 A 8/1983 Hayward
4,407,529 A 10/1983 Holman
4,408,821 A 10/1983 Forney, Jr.
4,408,822 A 10/1983 Nikitas
4,412,717 A 11/1983 Monroe
4,421,377 A 12/1983 Spinner
4,426,127 A 1/1984 Kubota
4,444,453 A 4/1984 Kirby et al.
4,452,503 A 6/1984 Forney, Jr.
4,456,323 A 6/1984 Pitcher et al.
4,462,653 A 7/1984 Flederbach et al.
4,464,000 A 8/1984 Werth et al.
4,464,001 A 8/1984 Collins
4,469,386 A 9/1984 Ackerman
4,470,657 A 9/1984 Deacon
4,477,132 A 10/1984 Moser et al.
4,484,792 A 11/1984 Tengler et al.
4,484,796 A 11/1984 Sato et al.
4,490,576 A 12/1984 Bolante et al.
4,506,943 A 3/1985 Drogo
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,633 A 10/1985 McGeary
4,545,637 A 10/1985 Bosshard et al.
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,632,487 A 12/1986 Wargula
4,634,213 A 1/1987 Larsson et al.
4,640,572 A 2/1987 Conlon
4,645,281 A 2/1987 Burger
4,647,135 A 3/1987 Reinhardt
4,650,228 A 3/1987 McMills et al.
4,655,159 A 4/1987 McMills
4,655,534 A 4/1987 Stursa
4,660,921 A 4/1987 Hauver
4,666,190 A 5/1987 Yamabe et al.
4,668,043 A 5/1987 Saba et al.
4,673,236 A 6/1987 Musolff et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gullusser et al.
4,703,988 A 11/1987 Raux et al.
4,713,021 A 12/1987 Kobler
4,717,355 A 1/1988 Mattis
4,720,155 A 1/1988 Schildkraut et al.
4,728,301 A 3/1988 Hemmer et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,739,009 A 4/1988 Down et al.
4,739,126 A 4/1988 Gutter et al.
4,746,305 A 5/1988 Nomura
4,747,656 A 5/1988 Miyahara et al.
4,747,786 A 5/1988 Hayashi et al.
4,749,821 A 6/1988 Linton et al.
4,755,152 A 7/1988 Elliot et al.
4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,789,759 A 12/1988 Jones
4,795,360 A 1/1989 Newman et al.
4,797,120 A 1/1989 Ulery
4,806,116 A 2/1989 Ackerman
4,807,891 A 2/1989 Neher
4,808,128 A 2/1989 Werth
4,810,017 A 3/1989 Knak et al.
4,813,886 A 3/1989 Roos et al.
4,820,185 A 4/1989 Moulin
4,834,675 A 5/1989 Samchisen
4,834,676 A 5/1989 Tackett
4,835,342 A 5/1989 Guginsky
4,836,580 A 6/1989 Farrell
4,836,801 A 6/1989 Ramirez
4,838,813 A 6/1989 Pauza et al.
4,846,731 A 7/1989 Alwine
4,854,893 A 8/1989 Morris
4,857,014 A 8/1989 Alf et al.
4,867,489 A 9/1989 Patel
4,867,706 A 9/1989 Tang
4,869,679 A 9/1989 Szegda
4,874,331 A 10/1989 Iverson
4,881,912 A 11/1989 Thommen et al.
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris

(56) References Cited

U.S. PATENT DOCUMENTS 4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,018,822 A 5/1991 Freismuth et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,139 A 10/1991 Spinner
5,059,747 A 10/1991 Bawa et al.
5,062,804 A 11/1991 Jamet et al.
5,066,248 A 11/1991 Gaver, Jr. et al.
5,067,912 A 11/1991 Bickford et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,150,924 A 9/1992 Yokomatsu et al.
5,154,636 A 10/1992 Vaccaro et al.
5,161,993 A 11/1992 Leibfried, Jr.
5,166,477 A 11/1992 Perin, Jr. et al.
5,167,545 A 12/1992 O'Brien et al.
5,169,323 A 12/1992 Kawai et al.
5,181,161 A 1/1993 Hirose et al.
5,183,417 A 2/1993 Bools
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,392 A 6/1993 Hosler, Sr.
5,217,393 A 6/1993 Del Negro et al.
5,221,216 A 6/1993 Gabany et al.
5,227,587 A 7/1993 Paterek
5,247,424 A 9/1993 Harris et al.
5,269,701 A 12/1993 Leibfried, Jr.
5,281,762 A 1/1994 Long et al.
5,283,853 A 2/1994 Szegda
5,284,449 A 2/1994 Vaccaro
5,294,864 A 3/1994 Do
5,295,864 A 3/1994 Birch et al.
5,316,348 A 5/1994 Franklin
5,316,494 A 5/1994 Flanagan et al.
5,318,459 A 6/1994 Shields
5,321,205 A 6/1994 Bawa et al.
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,362,251 A 11/1994 Bielak
5,366,260 A 11/1994 Wartluft
5,371,819 A 12/1994 Szegda
5,371,821 A 12/1994 Szegda
5,371,827 A 12/1994 Szegda
5,380,211 A 1/1995 Kawagauchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth
5,435,751 A 7/1995 Papenheim et al.
5,435,760 A 7/1995 Miklos
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,488,268 A 1/1996 Bauer et al.
5,490,033 A 2/1996 Cronin
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,320 A 3/1997 Wright
5,607,325 A 3/1997 Toma
5,609,501 A 3/1997 McMills et al.
5,620,339 A 4/1997 Gray et al.
5,632,637 A 5/1997 Diener
5,632,651 A 5/1997 Szegda
5,644,104 A 7/1997 Porter et al.
5,649,723 A 7/1997 Larsson
5,651,698 A 7/1997 Locati et al.
5,651,699 A 7/1997 Holliday
5,653,605 A 8/1997 Woehl et al.
5,667,405 A 9/1997 Holliday
5,681,172 A 10/1997 Moldenhauer
5,683,263 A 11/1997 Hsu
5,702,263 A 12/1997 Baumann et al.
5,722,856 A 3/1998 Fuchs et al.
5,735,704 A 4/1998 Anthony
5,743,131 A 4/1998 Holliday et al.
5,746,617 A 5/1998 Porter, Jr. et al.
5,746,619 A 5/1998 Harting et al.
5,769,652 A 6/1998 Wider
5,774,344 A 6/1998 Casebolt
5,775,927 A 7/1998 Wider
5,788,289 A 8/1998 Cronley
5,791,698 A 8/1998 Wartluft et al.
5,797,633 A 8/1998 Katzer et al.
5,817,978 A 10/1998 Hermant et al.
5,863,220 A 1/1999 Holliday
5,877,452 A 3/1999 McConnell
5,879,191 A 3/1999 Burris
5,882,226 A 3/1999 Bell et al.
5,897,795 A 4/1999 Lu et al.
5,906,511 A 5/1999 Bozzer et al.
5,917,153 A 6/1999 Geroldinger
5,921,793 A 7/1999 Phillips
5,938,465 A 8/1999 Fox, Sr.

(56) References Cited

U.S. PATENT DOCUMENTS 5,944,548 A 8/1999 Saito
5,951,327 A 9/1999 Marik
5,954,708 A 9/1999 Lopez et al.
5,957,716 A 9/1999 Buckley et al.
5,967,852 A 10/1999 Follingstad et al.
5,975,479 A 11/1999 Suter
5,975,591 A 11/1999 Guest
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,036,540 A 3/2000 Beloritsky
6,042,422 A 3/2000 Youtsey
6,048,229 A 4/2000 Lazaro, Jr.
6,053,743 A 4/2000 Mitchell et al.
6,053,769 A 4/2000 Kubota et al.
6,053,777 A 4/2000 Boyle
6,062,607 A 5/2000 Bartholomew
6,080,015 A 6/2000 Andreescu
6,083,053 A 7/2000 Anderson, Jr. et al.
6,089,903 A 7/2000 Stafford Gray et al.
6,089,912 A 7/2000 Tallis et al.
6,089,913 A 7/2000 Holliday
6,093,043 A 7/2000 Gray et al.
6,095,828 A 8/2000 Burland
6,095,841 A 8/2000 Felps
6,123,550 A 9/2000 Burkert et al.
6,123,567 A 9/2000 McCarthy
6,132,234 A 10/2000 Waidner et al.
6,146,197 A 11/2000 Holliday et al.
6,152,752 A 11/2000 Fukuda
6,152,753 A 11/2000 Johnson et al.
6,153,830 A 11/2000 Montena
6,162,995 A 12/2000 Bachle et al.
6,164,977 A 12/2000 Lester
6,174,206 B1 1/2001 Yentile et al.
6,183,298 B1 2/2001 Henningsen
6,199,913 B1 3/2001 Wang
6,199,920 B1 3/2001 Neustadtl
6,210,216 B1 4/2001 Tso-Chin et al.
6,210,219 B1 4/2001 Zhu et al.
6,210,222 B1 4/2001 Langham et al.
6,217,383 B1 4/2001 Holland et al.
6,238,240 B1 5/2001 Yu
6,239,359 B1 5/2001 Lilienthal, II et al.
6,241,553 B1 6/2001 Hsia
6,250,974 B1 6/2001 Kerek
6,257,923 B1 7/2001 Stone et al.
6,261,126 B1 7/2001 Stirling
6,267,612 B1 7/2001 Areykiewicz et al.
6,271,464 B1 8/2001 Cunningham
6,331,123 B1 12/2001 Rodrigues
6,332,815 B1 12/2001 Bruce
6,352,448 B1 3/2002 Holliday et al.
6,358,077 B1 3/2002 Young
6,361,348 B1 3/2002 Hall et al.
6,361,364 B1 3/2002 Holland et al.
6,375,509 B2 4/2002 Mountford
6,394,840 B1 5/2002 Gassauer et al.
6,396,367 B1 5/2002 Rosenberger
D458,904 S 6/2002 Montena
6,406,330 B2 6/2002 Bruce
6,409,534 B1 6/2002 Weisz-Margulescu
D460,739 S 7/2002 Fox
D460,740 S 7/2002 Montena
D460,946 S 7/2002 Montena
D460,947 S 7/2002 Montena
D460,948 S 7/2002 Montena
6,422,884 B1 7/2002 Babasick et al.
6,422,900 B1 7/2002 Hogan
6,425,782 B1 7/2002 Holland
D461,166 S 8/2002 Montena
D461,167 S 8/2002 Montena
D461,778 S 8/2002 Fox
D462,058 S 8/2002 Montena
D462,060 S 8/2002 Fox
6,439,899 B1 8/2002 Muzslay et al.
D462,327 S 9/2002 Montena
6,450,829 B1 9/2002 Weisz-Margulescu
6,454,463 B1 9/2002 Halbach
6,464,526 B1 10/2002 Seufert et al.
6,467,816 B1 10/2002 Huang
6,468,100 B1 10/2002 Meyer et al.
6,491,546 B1 12/2002 Perry
D468,696 S 1/2003 Montena
6,506,083 B1 1/2003 Bickford et al.
6,520,800 B1 2/2003 Michelbach et al.
6,530,807 B2 3/2003 Rodrigues et al.
6,540,531 B2 4/2003 Syed et al.
6,558,194 B2 5/2003 Montena
6,572,419 B2 6/2003 Feye-Homann
6,576,833 B2 6/2003 Covaro et al.
6,619,876 B2 9/2003 Vaitkus et al.
6,634,906 B1 10/2003 Yeh
6,663,397 B1 12/2003 Lin et al.
6,676,446 B2 1/2004 Montena
6,683,253 B1 1/2004 Lee
6,692,285 B2 2/2004 Islam
6,692,286 B1 2/2004 De Cet
6,695,636 B2 2/2004 Hall et al.
6,705,875 B2 3/2004 Berghorn et al.
6,705,884 B1 3/2004 McCarthy
6,709,280 B1 3/2004 Gretz
6,712,631 B1 3/2004 Youtsey
6,716,041 B2 4/2004 Ferderer et al.
6,716,062 B1 4/2004 Palinkas et al.
6,733,336 B1 5/2004 Montena et al.
6,733,337 B2 5/2004 Kodaira
6,752,633 B2 6/2004 Aizawa et al.
6,761,571 B2 7/2004 Hida
6,767,248 B1 7/2004 Hung
6,769,926 B1 8/2004 Montena
6,780,029 B1 8/2004 Gretz
6,780,042 B1 8/2004 Badescu et al.
6,780,052 B2 8/2004 Montena et al.
6,780,068 B2 8/2004 Bartholoma et al.
6,783,394 B1 8/2004 Holliday
6,786,767 B1 9/2004 Fuks et al.
6,790,081 B2 9/2004 Burris et al.
6,793,528 B2 9/2004 Lin et al.
6,802,738 B1 10/2004 Henningsen
6,805,583 B2 10/2004 Holliday et al.
6,805,584 B1 10/2004 Chen
6,808,415 B1 10/2004 Montena
6,817,272 B2 11/2004 Holland
6,817,896 B2 11/2004 Derenthal
6,817,897 B2 11/2004 Chee
6,827,608 B2 12/2004 Hall et al.
6,830,479 B2 12/2004 Holliday
6,848,115 B2 1/2005 Sugiura et al.
6,848,939 B2 2/2005 Stirling
6,848,940 B2 2/2005 Montena
6,848,941 B2 2/2005 Wlos et al.
6,884,113 B1 4/2005 Montena
6,884,115 B2 4/2005 Malloy
6,887,102 B1 5/2005 Burris et al.
6,929,265 B2 8/2005 Holland et al.
6,929,508 B1 8/2005 Holland
6,935,866 B2 8/2005 Kerekes et al.
6,939,169 B2 9/2005 Islam et al.
6,942,516 B2 9/2005 Shimoyama et al.
6,942,520 B2 9/2005 Barlian et al.
6,945,805 B1 9/2005 Bollinger
6,948,976 B2 9/2005 Goodwin et al.
6,953,371 B2 10/2005 Baker et al.
6,955,563 B1 10/2005 Croan
6,971,912 B2 12/2005 Montena et al.
7,008,263 B2 3/2006 Holland
7,018,216 B1 3/2006 Clark et al.
7,018,235 B1 3/2006 Burris et al.

(56) References Cited

U.S. PATENT DOCUMENTS

| | | | | |
|---|---|---|---|---|
| 7,029,326 | B2 | 4/2006 | Montena | |
| 7,063,565 | B2 | 6/2006 | Ward | |
| 7,070,447 | B1 | 7/2006 | Montena | |
| 7,077,697 | B2 | 7/2006 | Kooiman | |
| 7,086,897 | B2 | 8/2006 | Montena | |
| 7,090,525 | B1 | 8/2006 | Morana | |
| 7,094,114 | B2 | 8/2006 | Kurimoto | |
| 7,097,499 | B1 | 8/2006 | Purdy | |
| 7,102,868 | B2 | 9/2006 | Montena | |
| 7,108,547 | B2 | 9/2006 | Kisling et al. | |
| 7,112,078 | B2 | 9/2006 | Czikora | |
| 7,112,093 | B1 | 9/2006 | Holland | |
| 7,114,990 | B2 | 10/2006 | Bence et al. | 439/583 |
| 7,118,285 | B2 | 10/2006 | Fenwick et al. | |
| 7,118,382 | B2 | 10/2006 | Kerekes et al. | |
| 7,118,416 | B2 | 10/2006 | Montena et al. | |
| 7,125,283 | B1 | 10/2006 | Lin | |
| 7,128,604 | B2 | 10/2006 | Hall | |
| 7,131,867 | B1 | 11/2006 | Foster et al. | |
| 7,131,868 | B2 | 11/2006 | Montena | |
| 7,140,645 | B2 | 11/2006 | Cronley | |
| 7,144,271 | B1 | 12/2006 | Burris et al. | |
| 7,147,509 | B1 | 12/2006 | Burris et al. | |
| 7,156,696 | B1 | 1/2007 | Montena | |
| 7,161,785 | B2 | 1/2007 | Chawgo | |
| 7,165,974 | B2 | 1/2007 | Kooiman | |
| 7,173,121 | B2 | 2/2007 | Fang | |
| 7,179,121 | B1 | 2/2007 | Burris et al. | |
| 7,179,122 | B2 | 2/2007 | Holliday | |
| 7,182,639 | B2 | 2/2007 | Burris | |
| 7,189,114 | B1 | 3/2007 | Burris et al. | |
| 7,192,308 | B2 | 3/2007 | Rodrigues et al. | |
| 7,229,303 | B2 | 6/2007 | Vermoesen et al. | |
| 7,238,047 | B2 | 7/2007 | Saetele et al. | |
| 7,252,536 | B2 | 8/2007 | Lazaro, Jr. et al. | |
| 7,252,546 | B1 | 8/2007 | Holland | |
| 7,255,598 | B2 | 8/2007 | Montena et al. | |
| 7,261,594 | B2 | 8/2007 | Kodama et al. | |
| 7,264,502 | B2 | 9/2007 | Holland | |
| 7,278,882 | B1 | 10/2007 | Li | |
| 7,288,002 | B2 | 10/2007 | Rodrigues et al. | |
| 7,291,033 | B2 | 11/2007 | Hu | |
| 7,297,023 | B2 | 11/2007 | Chawgo | |
| 7,299,550 | B2 | 11/2007 | Montena | |
| 7,318,609 | B2 | 1/2008 | Naito et al. | |
| 7,322,846 | B2 | 1/2008 | Camelio | |
| 7,322,851 | B2 | 1/2008 | Brookmire | |
| 7,329,139 | B2 | 2/2008 | Benham | |
| 7,335,058 | B1 | 2/2008 | Burris et al. | |
| 7,347,129 | B1 | 3/2008 | Youtsey | |
| 7,347,726 | B2 | 3/2008 | Wlos | |
| 7,347,727 | B2 | 3/2008 | Wlos et al. | |
| 7,347,729 | B2 | 3/2008 | Thomas et al. | |
| 7,351,088 | B1 | 4/2008 | Qu | |
| 7,357,641 | B2 | 4/2008 | Kerekes et al. | |
| 7,364,462 | B2 | 4/2008 | Holland | |
| 7,371,112 | B2 | 5/2008 | Burris et al. | |
| 7,375,533 | B2 | 5/2008 | Gale | |
| 7,387,524 | B2 | 6/2008 | Cheng | |
| 7,393,245 | B2 | 7/2008 | Palinkas et al. | |
| 7,396,249 | B2 | 7/2008 | Kauffman | |
| 7,404,737 | B1 | 7/2008 | Youtsey | |
| 7,410,389 | B2 | 8/2008 | Holliday | |
| 7,416,415 | B2 | 8/2008 | Hart et al. | |
| 7,438,327 | B2 | 10/2008 | Auray et al. | |
| 7,452,239 | B2 | 11/2008 | Montena | |
| 7,455,550 | B1 | 11/2008 | Sykes | |
| 7,458,850 | B1 | 12/2008 | Burris et al. | |
| 7,458,851 | B2 | 12/2008 | Montena | |
| 7,462,068 | B2 | 12/2008 | Amidon | |
| 7,467,980 | B2 | 12/2008 | Chiu | |
| 7,476,127 | B1 | 1/2009 | Wei | |
| 7,478,475 | B2 | 1/2009 | Hall | |
| 7,479,033 | B1 | 1/2009 | Sykes et al. | |
| 7,479,035 | B2 | 1/2009 | Bence et al. | 439/583 |
| 7,484,988 | B2 | 2/2009 | Ma et al. | |
| 7,484,997 | B2 | 2/2009 | Hofling | |
| 7,488,210 | B1 | 2/2009 | Burris et al. | |
| 7,494,355 | B2 | 2/2009 | Hughes et al. | |
| 7,497,729 | B1 | 3/2009 | Wei | |
| 7,500,868 | B2 | 3/2009 | Holland et al. | |
| 7,500,873 | B1 | 3/2009 | Hart | |
| 7,507,116 | B2 | 3/2009 | Laerke et al. | |
| 7,507,117 | B2 | 3/2009 | Amidon | |
| 7,513,788 | B2 | 4/2009 | Camelio | |
| 7,544,094 | B1 | 6/2009 | Paglia et al. | |
| 7,563,133 | B2 | 7/2009 | Stein | |
| 7,566,236 | B2 | 7/2009 | Malloy et al. | |
| 7,568,945 | B2 | 8/2009 | Chee et al. | |
| 7,578,693 | B2 | 8/2009 | Yoshida et al. | |
| 7,588,454 | B2 | 9/2009 | Nakata et al. | |
| 7,607,942 | B1 | 10/2009 | Van Swearingen | |
| 7,625,227 | B1 | 12/2009 | Henderson et al. | |
| 7,632,143 | B1 | 12/2009 | Islam | |
| 7,635,283 | B1 | 12/2009 | Islam | |
| 7,651,376 | B2 | 1/2010 | Schreier | |
| 7,674,132 | B1 | 3/2010 | Chen | |
| 7,682,177 | B2 | 3/2010 | Berthet | |
| 7,682,188 | B1 | 3/2010 | Lu | |
| 7,714,229 | B2 | 5/2010 | Burris et al. | |
| 7,727,011 | B2 | 6/2010 | Montena et al. | |
| 7,749,021 | B2 | 7/2010 | Brodeur | |
| 7,753,705 | B2 | 7/2010 | Montena | |
| 7,753,710 | B2 | 7/2010 | George | |
| 7,753,727 | B1 | 7/2010 | Islam et al. | |
| 7,758,370 | B1 | 7/2010 | Flaherty | |
| 7,794,275 | B2 | 9/2010 | Rodrigues | |
| 7,806,714 | B2 | 10/2010 | Williams et al. | |
| 7,806,725 | B1 | 10/2010 | Chen | |
| 7,811,133 | B2 | 10/2010 | Gray | |
| D626,920 | S | 11/2010 | Purdy et al. | |
| 7,824,216 | B2 | 11/2010 | Purdy | 439/578 |
| 7,828,595 | B2 | 11/2010 | Mathews | |
| 7,830,154 | B2 | 11/2010 | Gale | |
| 7,833,053 | B2 | 11/2010 | Mathews | |
| 7,845,976 | B2 | 12/2010 | Mathews | |
| 7,845,978 | B1 | 12/2010 | Chen | |
| 7,845,980 | B1 | 12/2010 | Amidon | |
| 7,850,472 | B2 | 12/2010 | Friedrich et al. | |
| 7,850,487 | B1 | 12/2010 | Wei | |
| 7,857,661 | B1 | 12/2010 | Islam | |
| 7,874,870 | B1 | 1/2011 | Chen | |
| 7,887,354 | B2 | 2/2011 | Holliday | |
| 7,892,004 | B2 | 2/2011 | Hertzler et al. | |
| 7,892,005 | B2 | 2/2011 | Haube | 439/321 |
| 7,892,024 | B1 | 2/2011 | Chen | |
| 7,914,326 | B2 | 3/2011 | Sutter | |
| 7,918,687 | B2 | 4/2011 | Paynter et al. | |
| 7,927,135 | B1 | 4/2011 | Wlos | |
| 7,934,955 | B1 | 5/2011 | Hsia | |
| 7,942,695 | B1 | 5/2011 | Lu | |
| 7,950,958 | B2 | 5/2011 | Mathews | |
| 7,955,126 | B2 | 6/2011 | Bence et al. | |
| 7,972,158 | B2 | 7/2011 | Wild et al. | |
| 7,972,176 | B2 | 7/2011 | Burris et al. | |
| 7,982,005 | B2 | 7/2011 | Ames et al. | |
| 8,011,955 | B1 | 9/2011 | Lu | |
| 8,025,518 | B2 | 9/2011 | Burris et al. | |
| 8,029,315 | B2 | 10/2011 | Purdy et al. | |
| 8,029,316 | B2 | 10/2011 | Snyder et al. | |
| 8,062,044 | B2 | 11/2011 | Montena et al. | |
| 8,062,063 | B2 | 11/2011 | Malloy et al. | |
| 8,070,504 | B2 | 12/2011 | Amidon et al. | |
| 8,075,337 | B2 | 12/2011 | Malloy et al. | |
| 8,075,338 | B1 | 12/2011 | Montena | 439/578 |
| 8,079,860 | B1 | 12/2011 | Zraik | |
| 8,087,954 | B2 | 1/2012 | Fuchs | |
| 8,113,875 | B2 | 2/2012 | Malloy et al. | |
| 8,113,879 | B1 | 2/2012 | Zraik | |
| 8,157,587 | B2 | 4/2012 | Paynter et al. | |
| 8,157,588 | B1 | 4/2012 | Rodrigues et al. | |
| 8,167,635 | B1 | 5/2012 | Mathews | |
| 8,167,636 | B1 | 5/2012 | Montena | |
| 8,172,612 | B2 | 5/2012 | Bence et al. | |

(56) References Cited

U.S. PATENT DOCUMENTS 8,177,572 B2 5/2012 Feye-Hohmann
8,192,237 B2 6/2012 Purdy et al.
8,206,172 B2 6/2012 Katagiri et al.
D662,893 S 7/2012 Haberek et al.
8,231,412 B2 7/2012 Paglia et al.
8,262,408 B1 9/2012 Kelly
8,272,893 B2 9/2012 Burris et al.
8,287,320 B2 10/2012 Purdy et al.
8,313,345 B2 11/2012 Purdy
8,313,353 B2 11/2012 Purdy et al.
8,317,539 B2 11/2012 Stein
8,323,053 B2 12/2012 Montena
8,323,058 B2 12/2012 Flaherty et al.
8,323,060 B2 * 12/2012 Purdy et al. ..... 439/792
8,337,229 B2 12/2012 Montena
8,366,481 B2 2/2013 Ehret et al.
8,376,769 B2 2/2013 Holland et al.
D678,844 S 3/2013 Haberek
8,398,421 B2 3/2013 Haberek et al.
8,449,326 B2 5/2013 Holland et al.
8,465,322 B2 6/2013 Purdy
8,469,739 B2 * 6/2013 Rodrigues et al. ..... 439/578
8,469,740 B2 6/2013 Ehret et al.
D686,164 S 7/2013 Haberek et al.
D686,576 S 7/2013 Haberek et al.
8,475,205 B2 7/2013 Ehret et al.
8,480,430 B2 * 7/2013 Ehret et al. ..... 439/578
8,480,431 B2 7/2013 Ehret et al.
8,485,845 B2 7/2013 Ehret et al.
8,506,325 B2 8/2013 Malloy et al.
8,517,763 B2 8/2013 Burris et al.
8,517,764 B2 8/2013 Wei et al.
8,529,279 B2 * 9/2013 Montena ..... 439/322
8,550,835 B2 10/2013 Montena
8,568,163 B2 10/2013 Burris et al.
8,568,165 B2 10/2013 Wei et al.
8,591,244 B2 * 11/2013 Thomas et al. ..... 439/321
8,597,050 B2 12/2013 Flaherty et al.
8,636,529 B2 1/2014 Stein
8,636,541 B2 1/2014 Chastain et al.
8,647,136 B2 2/2014 Purdy et al.
8,690,603 B2 * 4/2014 Bence et al. ..... 439/583
8,721,365 B2 5/2014 Holland
8,727,800 B2 5/2014 Holland et al.
8,777,658 B2 7/2014 Holland et al.
8,777,661 B2 7/2014 Holland et al.
8,858,251 B2 10/2014 Montena
8,888,526 B2 11/2014 Burris
8,920,192 B2 12/2014 Montena
9,017,101 B2 4/2015 Ehret et al.
2001/0034143 A1 10/2001 Annequin
2001/0046802 A1 11/2001 Perry et al.
2001/0051448 A1 12/2001 Gonzalez
2002/0013088 A1 1/2002 Rodrigues et al.
2002/0019161 A1 2/2002 Finke et al.
2002/0038720 A1 4/2002 Kai et al.
2002/0146935 A1 10/2002 Wong
2003/0110977 A1 6/2003 Batlaw
2003/0119358 A1 6/2003 Henningsen
2003/0139081 A1 7/2003 Hall et al.
2003/0194890 A1 10/2003 Ferderer et al.
2003/0214370 A1 11/2003 Allison et al.
2003/0224657 A1 12/2003 Malloy
2004/0031144 A1 2/2004 Holland
2004/0077215 A1 4/2004 Palinkas et al.
2004/0102089 A1 5/2004 Chee
2004/0157499 A1 8/2004 Nania et al.
2004/0194585 A1 10/2004 Clark
2004/0209516 A1 10/2004 Burris et al.
2004/0219833 A1 11/2004 Burris et al.
2004/0229504 A1 11/2004 Liu
2005/0042919 A1 2/2005 Montena
2005/0079762 A1 4/2005 Hsia
2005/0159045 A1 7/2005 Huang
2005/0170692 A1 8/2005 Montena
2005/0181652 A1 8/2005 Montena et al.
2005/0181668 A1 8/2005 Montena et al.
2005/0208827 A1 9/2005 Burris et al.
2005/0233636 A1 10/2005 Rodrigues et al.
2006/0014425 A1 1/2006 Montena
2006/0099853 A1 5/2006 Sattele et al.
2006/0110977 A1 5/2006 Matthews
2006/0154519 A1 7/2006 Montena
2006/0166552 A1 7/2006 Bence et al.
2006/0178046 A1 8/2006 Tusini
2006/0194465 A1 8/2006 Czikora
2006/0223355 A1 10/2006 Hirschmann
2006/0246774 A1 11/2006 Buck
2006/0258209 A1 11/2006 Hall
2006/0276079 A1 12/2006 Chen
2007/0004276 A1 1/2007 Stein
2007/0026734 A1 2/2007 Bence et al.
2007/0049113 A1 3/2007 Rodrigues et al.
2007/0054535 A1 3/2007 Hall et al.
2007/0059968 A1 3/2007 Ohtaka et al.
2007/0082533 A1 4/2007 Currier et al.
2007/0087613 A1 4/2007 Schumacher et al.
2007/0123101 A1 5/2007 Palinkas
2007/0155232 A1 7/2007 Burris et al.
2007/0173100 A1 7/2007 Benham
2007/0175027 A1 8/2007 Khemakhem et al.
2007/0232117 A1 10/2007 Singer
2007/0243759 A1 10/2007 Rodrigues et al.
2007/0243762 A1 10/2007 Burke et al.
2007/0287328 A1 12/2007 Hart et al.
2008/0032556 A1 2/2008 Schreier
2008/0102696 A1 5/2008 Montena
2008/0171466 A1 7/2008 Buck et al.
2008/0200066 A1 8/2008 Hofling
2008/0200068 A1 8/2008 Aguirre
2008/0214040 A1 9/2008 Holterhoff et al.
2008/0289470 A1 11/2008 Aston
2009/0029590 A1 1/2009 Sykes et al.
2009/0098770 A1 4/2009 Bence et al.
2009/0104801 A1 4/2009 Silva
2009/0163075 A1 6/2009 Blew et al.
2009/0186505 A1 7/2009 Mathews
2009/0264003 A1 10/2009 Hertzler et al.
2009/0305560 A1 12/2009 Chen
2010/0007441 A1 1/2010 Yagisawa et al.
2010/0022125 A1 1/2010 Burris et al.
2010/0028563 A1 2/2010 Ota
2010/0055978 A1 3/2010 Montena
2010/0080563 A1 4/2010 DiFonzo et al.
2010/0081321 A1 4/2010 Malloy et al.
2010/0081322 A1 4/2010 Malloy et al.
2010/0087071 A1 4/2010 DiFonzo et al.
2010/0105246 A1 4/2010 Burris et al.
2010/0124839 A1 5/2010 Montena
2010/0130060 A1 5/2010 Islam
2010/0178799 A1 7/2010 Lee
2010/0216339 A1 8/2010 Burris et al.
2010/0233901 A1 9/2010 Wild et al.
2010/0233902 A1 9/2010 Youtsey
2010/0233903 A1 9/2010 Islam
2010/0255719 A1 10/2010 Purdy ..... 439/578
2010/0255721 A1 10/2010 Purdy et al.
2010/0279548 A1 11/2010 Montena et al.
2010/0297871 A1 11/2010 Haube ..... 439/489
2010/0297875 A1 11/2010 Purdy et al. ..... 439/578
2010/0304579 A1 12/2010 Kisling
2010/0323541 A1 12/2010 Amidon et al.
2011/0021072 A1 1/2011 Purdy ..... 439/578
2011/0021075 A1 1/2011 Orner et al.
2011/0027039 A1 2/2011 Blair
2011/0039448 A1 2/2011 Stein
2011/0053413 A1 3/2011 Mathews
2011/0074388 A1 3/2011 Bowman
2011/0080158 A1 4/2011 Lawrence et al.
2011/0111623 A1 5/2011 Burris et al.
2011/0111626 A1 5/2011 Paglia et al.
2011/0117774 A1 5/2011 Malloy et al.
2011/0143567 A1 6/2011 Purdy et al. ..... 439/277
2011/0151714 A1 6/2011 Flaherty et al.

(56) References Cited

U.S. PATENT DOCUMENTS

| | | | | |
|---|---|---|---|---|
| 2011/0230089 | A1 | 9/2011 | Amidon et al. | 439/578 |
| 2011/0230091 | A1 | 9/2011 | Krenceski et al. | 439/578 |
| 2011/0237123 | A1 | 9/2011 | Burris et al. | |
| 2011/0237124 | A1 | 9/2011 | Flaherty et al. | |
| 2011/0250789 | A1 | 10/2011 | Burris et al. | |
| 2011/0318958 | A1 | 12/2011 | Burris et al. | |
| 2012/0021642 | A1 | 1/2012 | Zraik | |
| 2012/0040537 | A1 | 2/2012 | Burris | |
| 2012/0045933 | A1 | 2/2012 | Youtsey | |
| 2012/0064768 | A1 | 3/2012 | Islam et al. | |
| 2012/0094530 | A1 | 4/2012 | Montena | |
| 2012/0100751 | A1 | 4/2012 | Montena | |
| 2012/0108098 | A1 | 5/2012 | Burris et al. | |
| 2012/0122329 | A1 | 5/2012 | Montena | |
| 2012/0129387 | A1 | 5/2012 | Holland et al. | |
| 2012/0171894 | A1 | 7/2012 | Malloy et al. | |
| 2012/0178289 | A1 | 7/2012 | Holliday | |
| 2012/0202378 | A1 | 8/2012 | Krenceski et al. | |
| 2012/0222302 | A1 | 9/2012 | Purdy et al. | |
| 2012/0225581 | A1 | 9/2012 | Amidon et al. | |
| 2012/0315788 | A1 | 12/2012 | Montena | |
| 2013/0065433 | A1 | 3/2013 | Burris | |
| 2013/0072057 | A1 | 3/2013 | Burris | |
| 2013/0178096 | A1 | 7/2013 | Matzen | |
| 2013/0273761 | A1 | 10/2013 | Ehret et al. | |
| 2014/0106612 | A1 | 4/2014 | Burris | |
| 2014/0106613 | A1 | 4/2014 | Burris | |
| 2014/0120766 | A1 | 5/2014 | Meister et al. | |
| 2014/0137393 | A1 | 5/2014 | Chastain et al. | |
| 2014/0148051 | A1 | 5/2014 | Bence et al. | |
| 2014/0154907 | A1 | 6/2014 | Ehret et al. | |
| 2014/0322968 | A1 | 10/2014 | Burris | |

FOREIGN PATENT DOCUMENTS

| | | |
|---|---|---|
| CN | 201149937 | 11/2008 |
| CN | 201178228 | 1/2009 |
| CN | 201904508 | 7/2011 |
| DE | 47931 | 10/1888 |
| DE | 102289 | 7/1897 |
| DE | 1117687 | 11/1961 |
| DE | 2261973 | 6/1974 |
| DE | 3211008 | 10/1983 |
| DE | 9001608.4 | 4/1990 |
| DE | 4439852 | 5/1996 |
| DE | 19957518 | 9/2001 |
| EP | 116157 | 8/1984 |
| EP | 167738 | 1/1986 |
| EP | 72104 | 2/1986 |
| EP | 265276 | 4/1988 |
| EP | 428424 | 5/1991 |
| EP | 1191268 | 3/2002 |
| EP | 1501159 | 1/2005 |
| EP | 1548898 | 6/2005 |
| EP | 1603200 | 12/2005 |
| EP | 1701410 | 9/2006 |
| EP | 2051340 | 4/2009 |
| FR | 2232846 | 1/1975 |
| FR | 2462798 | 2/1981 |
| FR | 2494508 | 5/1982 |
| GB | 589697 | 6/1947 |
| GB | 1087228 | 10/1967 |
| GB | 1270846 | 4/1972 |
| GB | 1332888 | 10/1973 |
| GB | 1401373 | 7/1975 |
| GB | 1421215 | 1/1976 |
| GB | 2019665 | 10/1979 |
| GB | 2079549 | 1/1982 |
| GB | 2252677 | 8/1992 |
| GB | 2264201 | 8/1993 |
| GB | 2331634 | 5/1999 |
| GB | 2448595 | 10/2008 |
| GB | 2450248 | 12/2008 |
| JP | 3280369 | 12/1991 |
| JP | 200215823 | 1/2002 |
| JP | 4503793 | 7/2010 |
| KR | 100622526 | 9/2006 |
| TW | 427044 | 3/2001 |
| WO | 8700351 | 1/1987 |
| WO | 0186756 | 11/2001 |
| WO | 02069457 | 9/2002 |
| WO | 2004013883 | 2/2004 |
| WO | 2006081141 | 8/2006 |
| WO | 2007062845 | 6/2007 |
| WO | 2009066705 | 5/2009 |
| WO | 2010135181 | 11/2010 |
| WO | 2011057033 | 5/2011 |
| WO | 2012162431 | 5/2011 |
| WO | 2011128665 | 10/2011 |
| WO | 2011128666 | 10/2011 |
| WO | 2013126629 | 8/2013 |

OTHER PUBLICATIONS

Office Action dated Aug. 25, 2014 pertaining to U.S. Appl. No. 13/605,481.

Election/Restrictions Requirement dated Jul. 31, 2014 pertaining to U.S. Appl. No. 13/652,969.

Election/Restrictions Requirement dated Jun. 20, 2014 pertaining to U.S. Appl. No. 13/795,780.

Office Action dated Sep. 19, 2014 pertaining to U.S. Appl. No. 13/795,780.

Office Action dated Oct. 6, 2014 pertaining to U.S. Appl. No. 13/732,679.

Office Action dated Dec. 31, 2014 pertaining to U.S. Appl. No. 13/605,498.

Office Action dated Dec. 16, 2014 pertaining to U.S. Appl. No. 13/653,095.

Office Action dated Dec. 19, 2014 pertaining to U.S. Appl. No. 13/652,969.

Office Action dated Dec. 29, 2014 pertaining to U.S. Appl. No. 13/833,793.

Corning Cabelcon waterproof CX3 7.0 QuickMount for RG6 cables; Cabelcon Connectors; www.cabelcom.dk; Mar. 15, 2012.

Maury Jr., M.; Microwave Coaxial Connector Technology: A Continuaing Evolution; Maury Microwave Corporation; Dec. 13, 2005; pp. 1-21; Maury Microwave Inc.

"Snap-On/Push-On" SMA Adapter; RF TEC Mfg., Inc.; Mar. 23, 2006; 2 pgs.

RG6 quick mount data sheet; Corning Cabelcon; 2010; 1 pg.; Corning Cabelcon ApS.

RG11 quick mount data sheet; Corning Cabelcon; 2013; 1 pg.; Corning Cabelcon ApS.

Gilbert Engineering Co., Inc.; OEM Coaxial Connectors catalog; Aug. 1993; p. 26.

UltraEase Compression Connectors; "F" Series 59 and 6 Connectors Product Information; May 2005; 4 pgs.

Pomona Electronics Full Line Catelog; vol. 50; 2003; pp. 1-100.

Corning Gilbert 2004 OEM Coaxial Products Catalog, Quick Disconnects, 2 pages.

US Office Action, U.S. Appl. No. 10/997,218; Jul. 31, 2006, pp. 1-10.

Society of Cable Telecommunications Engineers, Engineering Committee, Interface Practices Subcommittee; American National Standard; ANSI/SCTE 01 2006; Specification for "F" Port, Female, Outdoor. Published Jan. 2006. 9 pages.

The American Society of Mechanical Engineers; "Lock Washers (Inch Series), An American National Standard"; ASME 818.21.1-1999 (Revision of ASME B18.21.1-1994); Reaffirmed 2005. Published Feb. 11, 2000. 28 pages.

U.S. Reexamination Control No. 90/012,300, filed Jun. 29, 2012, regarding U.S. Pat. No. 8,172,612 filed May 27, 2011 (Bence et al.).

U.S. Reexamination Control No. 90/012,749 filed Dec. 21, 2012, regarding U.S. Pat. No. 7,114,990, filed Jan. 25, 2005 (Bence et al.).

U.S. Reexamination Control No. 90/012,835 filed Apr. 11, 2013, regarding U.S. Pat. No. 8,172,612 filed May 27, 2011 (Bence et al.).

Notice of Allowance (Mail Date Mar. 20, 2012) for U.S. Appl. No. 13/117,843.

(56) References Cited

OTHER PUBLICATIONS

Search Report dated Jun. 6, 2014 pertaining to International application No. PCT/US2014/023374.
Search Report dated Apr. 9, 2014 pertaining to International application No. PCT/US2014/015934.
Society of Cable Telecommunications Engineers, Engineering Committee, Interface Practices Subcommittee; American National Standard; ANSI/SCTE 02 2006; "Specification for "F" Port, Female, Indoor". Published Feb. 2006. 9 pages.
PPC, "Next Generation Compression Connectors," pp. 1-6, Retrieved from http://www.tessco.com/yts/partnearnanufacturer list/vendors/ppc/pdf/ppc digital spread.pdf.
Pat. Cooperation Treaty, International Search Report for PCT/US2013/070497, Feb. 11, 2014, 3 pgs.
Pat. Cooperation Treaty, International Search Report for PCT/US2013/064515, 10 pgs.
Pat. Cooperation Treaty, International Search Report for PCT/US2013/064512, Jan. 21, 2014, 11 pgs.
Huber+Suhner AG, RF Connector Guide: Understanding connector technology, 2007, Retrieved from http://www.ie.itcr.ac.cr/marin/lic/e14515/HUBER+SUENER_RF_Connector_Guide.pdf.
Slade, Paul G,. Electrical Contacts: Principles and Applications, 1999, Retrieved from http://books.google.com/books (table of contents only).
U.S. Reexamination Control No. 95/002,400 filed Sep. 15, 2012, regarding U.S. Pat. No. 8,192,237 filed Feb. 23, 2011 (Purdy et al.).
U.S. Reexamination Control No. 90/013,068 filed Nov. 27, 2013, regarding U.S. Pat. No. 6,558,194 filed Jul. 21, 2000 (Montena).
U.S. Reexamination Control No. 90/013,069 filed Nov. 27, 2013, regarding U.S. Pat. No. 6,848,940 filed Jan. 21, 2003 (Montena).
U.S. Inter Partes Review Case No. 2013-00346 filed Jun. 10, 2013, regarding U.S. Pat. No. 8,287,320 filed Dec. 8, 2009, claims 1-8, 10-16, 18-31 (Purdy et al.).
U.S. Inter Partes Review Case No. 2013-00343 filed Jun. 10, 2013, regarding U.S. Pat. No. 8,313,353 filed Apr. 30, 2012, claims 1-6 (Purdy et al.).
U.S. Inter Partes Review Case No. 2013-00340 filed Jun. 10, 2013, regarding U.S. Pat. No. 8,323,060 filed Jun. 14, claims 1-9 (Purdy et al.).
U.S. Inter Partes Review Case No. 2013-00347 filed Jun. 10, 2013, regarding U.S. Pat. No. 8,287,320 filed Dec. 8, 2009, claims 9, 17, 32 (Purdy et al.).
U.S. Inter Partes Review Case No. 2013-00345 filed Jun. 10, 2013, regarding U.S. Pat. No. 8,313,353 filed Apr. 30, 2012, claims 7-27 (Purdy et al.).
U.S. Inter Partes Review Case No. 2013-00342 filed Jun. 10, 2013, regarding U.S. Pat. No. 8,323,060 filed Jun. 14, 2012, claims 10-25 (Purdy et al.).
U.S. Inter Partes Review Case No. 2014-00441 filed Feb. 18, 2014, regarding U.S. Pat. No. 8,562,366 filed Oct. 15, 2012, claims 31,37, 39, 41, 42, 55 56 (Purdy et al.).
U.S. Inter Partes Review Case No. 2014-00440 filed Feb. 18, 2014, regarding U.S. Pat. No. 8,597,041 filed Oct. 15, 2012, claims 1, 8, 9, 11, 18-26, 29 (Purdy et al.).
Office Action dated Mar. 19, 2015 pertaining to U.S. Appl. No. 13/795,780.
Notice of Allowance dated Feb. 2, 2015 pertaining to U.S. Appl. No. 13/795,737.
Office Action dated Feb. 25, 2015 pertaining to U.S. Appl. No. 13/605,481.

* cited by examiner

COAXIAL CABLE CONTINUITY CONNECTOR

RELATED APPLICATIONS

This application claims the benefit of priority under 35 U.S.C. §119 of U.S. Provisional Application Ser. No. 61/770,715 filed on Feb. 28, 2013, the content of which is relied upon and incorporated herein by reference in its entirety.

This application claims the benefit of priority under 35 U.S.C. §119 of U.S. Provisional Application Ser. No. 61/766,436 filed on Feb. 19, 2013, the content of which is relied upon and incorporated herein by reference in its entirety.

This application is related to U.S. application Ser. No. 13/198,765, filed Aug. 5, 2011, entitled "Coaxial Cable Connector with Radio Frequency Interference and Grounding Shield", which is incorporated herein by reference in its entirety.

This application is related to U.S. application Ser. No. 13/653,095, filed Oct. 16, 2012, entitled "Coaxial Cable Connector with Integral RFI Protection", which is incorporated herein by reference in its entirety.

This application is related to U.S. application Ser. No. 13/652,969, filed Oct. 16, 2012, entitled "Coaxial Cable Connector With Integral Continuity Contacting Portion", which is incorporated herein by reference in its entirety.

BACKGROUND

1. Field of the Disclosure

The disclosure relates generally to coaxial cable connectors, and particularly to a coaxial cable connector having a continuity member.

2. Technical Background

Coaxial cable connectors, such as type F connectors, are used to attach coaxial cable to another object or appliance, e.g., a television set, DVD player, modem or other electronic communication device having a terminal adapted to engage the connector. The terminal of the appliance includes an inner conductor and a surrounding outer conductor.

Coaxial cable includes a center conductor for transmitting a signal. The center conductor is surrounded by a dielectric material, and the dielectric material is surrounded by an outer conductor. The outer conductor may be in the form of a conductive foil and/or braided sheath. The outer conductor is typically maintained at ground potential to shield the signal transmitted by the center conductor from stray noise, and to maintain a continuous, desired impedance over the signal path. The outer conductor is usually surrounded by a plastic cable jacket that electrically insulates, and mechanically protects, the outer conductor. Prior to installing a coaxial connector onto an end of the coaxial cable, the end of the coaxial cable is typically prepared by stripping off the end portion of the jacket to expose the end portion of the outer conductor. Similarly, it is common to strip off a portion of the dielectric to expose the end portion of the center conductor.

Coaxial cable connectors of the type known in the trade as "F connectors" often include a tubular post designed to slide over the dielectric material, and under the outer conductor of the coaxial cable, at the prepared end of the coaxial cable. If the outer conductor of the cable includes a braided sheath, then the exposed braided sheath is usually folded back over the cable jacket. The cable jacket and folded-back outer conductor extend generally around the outside of the tubular post and are typically received in an outer body of the connector. The outer body of the connector is often fixedly secured to the tubular post. A coupler is typically rotatably secured around the tubular post and includes an internally-threaded region for engaging external threads formed on the outer conductor of the appliance terminal. Alternatively or additionally, the coupler may friction fit, screw and/or latch on to the outer conductor of the appliance terminal.

When connecting the end of a coaxial cable to a terminal of a television set, equipment box, modem, computer or other appliance, it is important to achieve a reliable electrical connection between the outer conductor of the coaxial cable and the outer conductor of the appliance terminal. Typically, this goal is usually achieved by ensuring that the coupler of the connector is fully tightened over the connection port of the appliance. When fully tightened, the head of the tubular post of the connector directly engages the edge of the outer conductor of the appliance port, thereby making a direct electrical ground connection between the outer conductor of the appliance port and the tubular post. The tubular post is engaged with the outer conductor of the coaxial cable.

The increased use of self-install kits provided to home owners by some CATV system operators has resulted in customer complaints due to poor picture quality in video systems and/or poor data performance in computer/internet systems. Additionally, CATV system operators have found upstream data problems induced by entrance of unwanted RF signals into their systems. Complaints of this nature result in CATV system operators having to send a technician to address the issue. Often times it is reported by the technician that the cause of the problem is due to a loose F connector fitting, sometimes as a result of inadequate installation of the self-install kit by the homeowner. An improperly installed or loose connector may result in poor signal transfer because there are discontinuities along the electrical path between the devices, resulting in ingress of undesired radio frequency ("RF") signals where RF energy from an external source or sources may enter the connector/cable arrangement causing a signal to noise ratio problem resulting in an unacceptable picture or data performance. Many of the current state of the art F connectors rely on intimate contact between the F male connector interface and the F female connector interface. If, for some reason, the connector interfaces are allowed to pull apart from each other, such as in the case of a loose F male coupler, an interface "gap" may result. If not otherwise protected this gap can be a point of RF ingress as previously described.

As mentioned above, the coupler is typically rotatably secured about the head of the tubular post. The head of the tubular post usually includes an enlarged shoulder, and the coupler typically includes an inwardly-directed flange for extending over and around the shoulder of the tubular post. In order not to interfere with free rotation of the coupler, manufacturers of such F-style connectors routinely make the outer diameter of the shoulder (at the head of the tubular post) of smaller dimension than the inner diameter of the central bore of the coupler. Likewise, manufacturers routinely make the inner diameter of the inwardly-directed flange of the coupler of larger dimension than the outer diameter of the non-shoulder portion of the tubular post, again to avoid interference with rotation of the coupler relative to the tubular post. In a loose connection system, wherein the coupler of the coaxial connector is not drawn tightly to the appliance port connector, an alternate ground path may fortuitously result from contact between the coupler and the tubular post, particularly if the coupler is not centered over, and axially aligned with, the tubular post. However, this alternate ground path is not stable, and can be disrupted as a result of vibrations, movement of the appliance, movement of the cable, or the like.

Alternatively, there are some cases in which such an alternate ground path is provided by fortuitous contact between the coupler and the outer body of the coaxial connector, provided that the outer body is formed from conductive material. This alternate ground path is similarly unstable, and may be interrupted by relative movement between the appliance and the cable, or by vibrations. Moreover, this alternate ground path does not exist at all if the outer body of the coaxial connector is constructed of non-conductive material. Such unstable ground paths can give rise to intermittent failures that are costly and time-consuming to diagnose.

SUMMARY OF THE DETAILED DESCRIPTION

One embodiment disclosed herein relates to a coaxial connector for coupling an end of a coaxial cable to an equipment appliance port or terminal. The coaxial cable has an inner conductor, a dielectric surrounding the inner conductor, an outer conductor surrounding the dielectric, and a jacket surrounding the outer conductor. The coaxial cable connector comprises a body, a coupler rotatably attached to the body, and a post secured to the body. The post has a structural feature. A grounding member is disposed between the post and the coupler in the structural feature. The grounding member establishes an electrical grounding path which may be maintained between coupler and post, including, when the coupler is not tightly fastened to an appliance port.

Another embodiment disclosed herein relates to a coaxial cable connector for coupling an end of a coaxial cable to an equipment appliance port or terminal. The coaxial cable has an inner conductor, a dielectric surrounding the inner conductor, an outer conductor surrounding the dielectric, and a jacket surrounding the outer conductor. The connector has a body, a coupler rotatably attached to the body with the coupler having a lip with a forward facing surface, and a post secured to the body. The post has a first end, a head, a neck, and a second end, and a structural feature. A grounding member having an arcuate shape is disposed in and retained by the structural feature between the post and the coupler. The grounding member is resilient and biased toward coupler and establishes an electrical grounding path between the post and the coupler such that the electrical grounding path is maintained between the post and the coupler when the coupler is not tightly fastened to an appliance port. The structural feature may be a groove in the post or formed by a tapered portion and a first radial face of the post.

Additional features and advantages will be set forth in the detailed description which follows, and in part will be readily apparent to those skilled in the art from that description or recognized by practicing the embodiments as described in the detailed description and claims hereof, as well as the appended drawings.

It is to be understood that both the foregoing general description and the following detailed description are merely exemplary, and are intended to provide an overview or framework to understanding the nature and character of the claims.

The accompanying drawings are included to provide a further understanding, and are incorporated in and constitute a part of this specification. The drawings illustrate one or more embodiment(s), and together with the description serve to explain principles and operation of the various embodiments.

DETAILED DESCRIPTION

Reference will now be made in detail to the embodiments, examples of which are illustrated in the accompanying drawings, in which some, but not all embodiments are shown. Indeed, the concepts may be embodied in many different forms and should not be construed as limiting herein. Whenever possible, like reference numbers will be used to refer to like components or parts.

Coaxial cable connectors are used to couple a prepared end of a coaxial cable to a threaded female equipment connection port of an appliance. The coaxial cable provides an electrical and mechanical connection between the conductor of the coaxial connector and the conductor of the female equipment connection terminal port, and establishes a ground path from an outer conductor of the coaxial cable to the terminal or equipment appliance port.

Embodiments disclosed herein include a coaxial connector for coupling an end of a coaxial cable to an equipment appliance port or terminal. The coaxial cable has an inner conductor, a dielectric surrounding the inner conductor, an outer conductor surrounding the dielectric, and a jacket surrounding the outer conductor. The coaxial cable connector comprises a body, a coupler rotatably attached to the body, and a post secured to the body. The post has a structural feature. A grounding member is disposed between the post and the coupler in the structural feature. The grounding member establishes and maintains an electrical grounding path between coupler and post, including, when the coupler is not tightly fastened to a terminal or equipment appliance port.

For purposes of this description, the term "forward" will be used to refer to a direction toward the portion of the coaxial cable connector that attaches to a terminal, including an equipment appliance port. The term "rearward" will be used to refer to a direction that is toward the portion of the coaxial cable connector that receives the coaxial cable. The term "terminal" will be used to refer to any type of connection medium to which the coaxial cable connector may be coupled, as non-limiting examples, an equipment appliance port, any other type of connection port, or an intermediate termination device.

Figure 1:
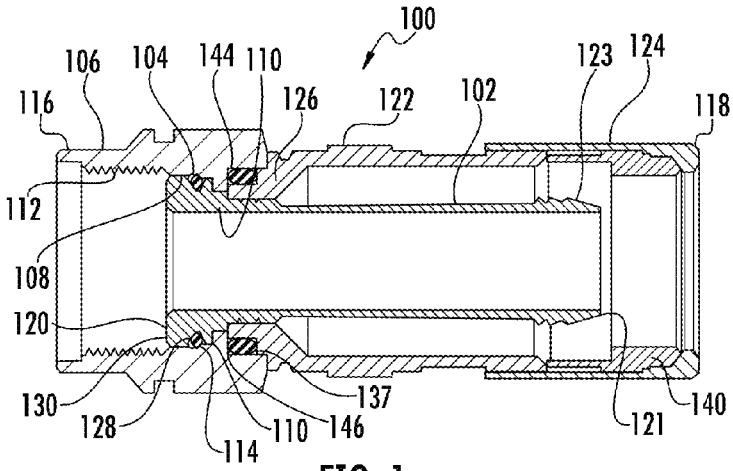
FIG. 1 is a cross-sectional view of an exemplary embodiment of a coaxial connector comprising a post, a grounding member and a coupler having a secondary bore with a tapered transition and the post includes a structural feature in the form of a channel.

FIG. 1 illustrates a coaxial cable connector 100 having a post 102, a grounding member 104, a coupler 106, a front end 116 and a back end 118. Coupler 106 has a first bore 108. a second bore 110, a lip 132 with a forward facing surface 134 and a rearward facing surface 136. First bore 108 may have a threaded portion 112, and second bore 110 may have a tapered transition portion 114. Post 102 has first end 120, head 130, neck 138 and second end 121 with coupler 106 rotatably secured over end 120 of post 102 for attaching the connector 100 to an appliance (not shown). Barbs 123 located on post 102 proximate second end 121 facilitate attaching coaxial cable to connector 100 which is discussed in more detail with reference to FIG. 7. Head 130 has bottom surface 142, forward facing surface 144 and a rearward facing surface 146. Body 122 secures to post 102 and shell 124 movably secures to body 122 such that shell 124 may slide over body 122. Gripping member 140 friction fits in shell 124. O-ring 137 may be positioned between coupler 106 and body 122 to provide environmental protection for the coaxial cable connector 100. Body 122 may be made of brass, plated with nickel. Shell 124 also may be made of brass, plated with nickel. Post 102 may be metallic, for example, brass, with a tin plating. Coupler 106 may be metallic, for example, brass, and plated with nickel or with another non-corrosive material.

In FIG. 1, coupler 106 is shown rotatably secured over end 120 of post 102 via a neck 126 of the body 122. An electrical grounding path may be established and maintained between coupler 106 and post 102, including, in particular, when the coupler 106 is not tightly fastened to the terminal using grounding member 104, which is resilient and electrically-conductive. Grounding member 104 may be disposed between post 102 and coupler 106 in structural feature in post 102, which is described in more detail with reference to FIG. 1A.

Figure 1A:
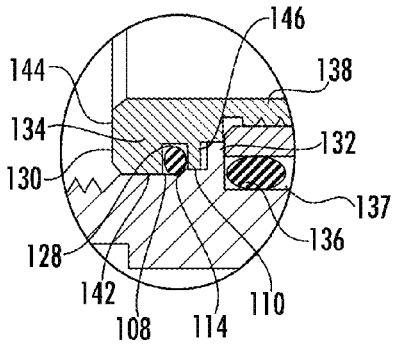
FIG. 1A is a detail cross-sectional view of a portion of the coaxial connector of FIG. 2 illustrating the post, grounding member and coupler.

In this regard, as shown in FIG. 1A, structural feature in post 102 is shown as annular groove 128 in bottom surface 142 of head 130 of post 102. Grounding member 104 is disposed about and retained by annular groove 128 in post 102 proximate tapered transition portion 114 and about head 130 of post 102. Grounding member 104 is resilient and biased toward coupler 106 such that grounding member 104 contacts both post 102 and tapered transition portion 114 of coupler 106. In this way, grounding member 104 establishes and maintains an electrically-conductive, stable ground path between coupler 106 and post 102, including, in particular, when the coupler 106 is not tightly fastened to the terminal.

Figure 1B:
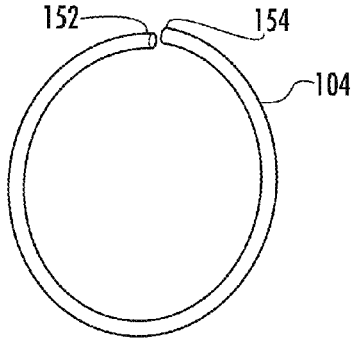
FIG. 1B is a detail, perspective view of the continuity member of the coaxial connector of FIG. 1.
Figure 1C:
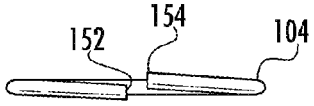
FIG. 1C is a detail, plan view of the continuity member of the coaxial connector of FIG. 1.

Referring also now to FIGS. 1B and 1C, details of grounding member 104 are shown. Grounding member 104 is shown as a spring member, or circlip, which may be constructed of a wire-type material. The spring action of the grounding member 104 serves to form a ground path from coupler 106 to tubular post 102 while allowing coupler 106 to rotate. Grounding member 104 is resilient and may be generally arcuately shaped, having first end 152 and second end 154, and may extend around post 102 over an arc of at least 225 degrees. Further, grounding member 104 may extend for a full 360 degrees or more. Grounding member 104 may be in the form of a generally circular or generally non-circular broken ring, or C-shaped member, formed as by bending a strip of metal wire into an arc, or from a C-shaped metal clip. Additionally, grounding member 104 may be in the form of a partial helical shape such that first end 152 and second end 154 are offset. Grounding member 104 may be made of stainless steel wire having a wire diameter of between 0.010-inch and 0.020-inch, such as, about 0.016-inch. Grounding member 104 may be constructed of stainless steel, and, therefore, may not be plated for corrosion resistance.

Figure 2:
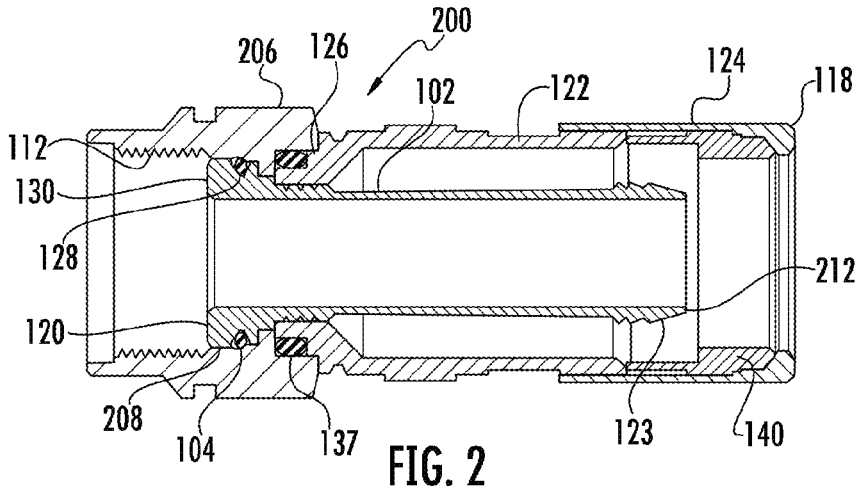
FIG. 2 is a cross-sectional view of an exemplary embodiment of a coaxial connector comprising a post, a grounding member and a coupler having a uniform bore without a tapered transition and the post includes a structural feature in the form of a channel.

FIG. 2 illustrates a coaxial cable connector 200. Wherever possible, the same numbers for the same components as used for coaxial cable connector 100, will be used to describe coaxial cable connector 200. Additionally, components with the same or similar function as in coaxial cable connector 100 may not be described again with respect to coaxial cable connector 200. In at least one aspect, coaxial cable connector 200 differs from coaxial cable connector 100 in that coaxial cable connector 200 comprises coupler 206 not having a second bore 110 with a tapered transition portion 114. Instead, coupler 206 comprises straight bore 208. Coupler 206 is shown rotatably secured over end 120 of post 102 via a neck 126 of the body 122. The electrical grounding path may be established by grounding member 104, which is resilient and electrically-conductive. In this way, an electrical grounding path may be established and maintained between coupler 206 and post 102, including, in particular, when the coupler 206 is not tightly fastened to the terminal. Grounding member 104 may be disposed between post 102 and coupler 206 in structural feature in post 102, a detail of which is shown in FIG. 2A.

Figure 2A:
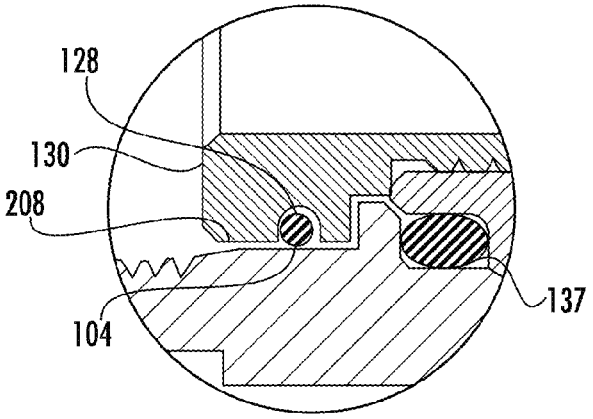
FIG. 2A is a detail, cross-sectional view of a portion of the coaxial connector of FIG. 2 illustrating the post, grounding member and coupler.

Referring now to FIG. 2A, similar to the embodiment illustrated in FIG. IA, structural feature in post 102 is an annular groove 128. Grounding member 104 is disposed about and retained by annular groove 128 in post 102 proximate straight bore 208 and about head 130 of the post 102, and may be a spring member, or circlip, as described with reference to FIGS. 1B and 1C. Grounding member 104 is resilient and biased toward coupler 206, such that grounding member 104 contacts both post 102 and coupler 206. In this way, grounding member 104 establishes and maintains an electrically-conductive, stable ground path between coupler 206 and post 102, including, in particular, when the coupler 206 is not tightly fastened to the terminal.

Figure 3:
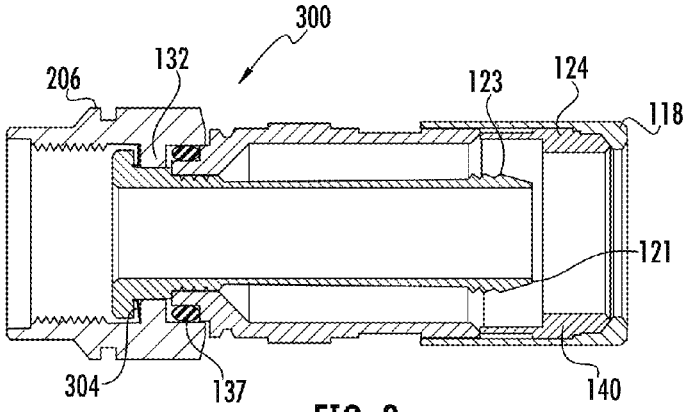
FIG. 3 is a cross-sectional view of an exemplary embodiment of a coaxial connector comprising a post, a grounding member and a coupler having a uniform bore without a tapered transition and the post includes a structural feature in the form of a circumferential groove.

FIG. 3 illustrates coaxial cable connector 300. Wherever possible, the same numbers for the same components as used for coaxial cable connector 100, will be used to describe coaxial cable connector 300. Additionally, components with the same or similar function as in coaxial cable connector 100 may not be described again with respect to coaxial cable connector 300. Coaxial cable connector 300 includes coupler 206, post 302, and grounding member 304, with coupler 206 having straight bore 208. In at least one aspect, coaxial cable connector 300 differs from coaxial cable connector 100 in that rearward facing surface 146 of head 130 of post 302 has a structural feature such that grounding member 304 may be positioned between rearward facing surface 146 of head 130 and forward facing surface 134 of lip 132, which is described in more detail with reference to FIG. IA.

Figure 3A:
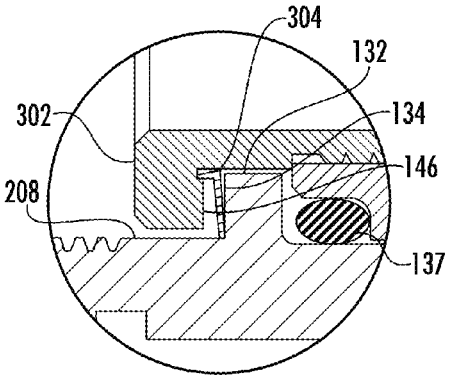
FIG. 3A is a detail, cross-sectional view of a portion of the coaxial connector of FIG. 3 illustrating the post, grounding member and coupler.

In this regard, as shown in FIG. 3A, the structural feature is a circumferential groove 328 in the rearward facing surface 146 of head 130 of post 302. Grounding member 304 has ring 348 which may position around and be press-fit to neck 138 of post 302. The ring 348 fits into and is retained by the circumferential groove 328 such that ring 348 may be "sandwiched" between the post 302 and the coupler 206 to provide a bearing surface between the coupler 206 and the post 302 when the coupler 206 is fully tightened against a terminal. Annular beam 350 extends from ring 348 and contacts forward facing surface 134 of lip 132 and may be a resilient, spring-like extension from ring 348. In this way, when coupler 206 is not fully tightened on a terminal, annular beam 350 of grounding member 304 maintains contact between post 302 and forward facing surface 134 of lip 132 of coupler 206.

Figure 3B:
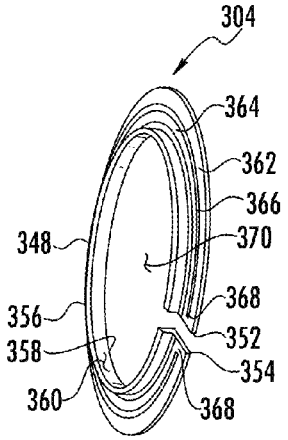
FIG. 3B is a detail, perspective view of the continuity member of the coaxial connector of FIG. 3.

Referring now to FIG. 3B, there is shown a perspective view of grounding member 304 having ring 348 and resilient, spring-type extension 350. Grounding member 304 is resilient and is generally arcuately shaped and may have first end 352 and second end 354. Grounding member 304 may extend over an arc of at least 225 degrees, and may extend for 360 degrees. Ring 348 may have first edge 356 and second edge 358 with width 360 between first edge 356 and second edge 360. Width 360 may be about 0.020 inches. Annular beam 350 may be pre-formed and cantilevered extending radially from ring 348. Additionally, grounding member 304 may have a plurality of pre-formed cantilevered annular beams 350. The annular beam 350 is flexible, resilient, arcuately shaped and extend at approximately a 10 degree angle from the plane of the ring 348. Annular beam 350 may have an outer surface 362, an inner surface 364 and a slot 366 therebetween. Joining segments 368 may join the outer surface 362 to the inner surface 364 and, thereby, to ring 348. The ring 348 defines a central aperture 370, which may be an open through space. Ring 348 may position about neck 138 of post 102 such that neck 138 fits into central aperture 370. At least one of the plurality of annular beams 350 contacts forward facing surface 134 of lip 132 of coupler 106. In this way, a ground path is may be established and maintained between post 102 and coupler 106. Grounding member 304 may be made from a metallic material, including as a non-limiting example, phosphor bronze. Additionally or alternatively, grounding member 304 may be un-plated or may be plated with a conductive material, as non-limiting examples, tin, tin-nickel or the like. Further, grounding member 104 may be constructed of stainless steel, and, therefore, may not be plated for corrosion resistance.

Figure 4:
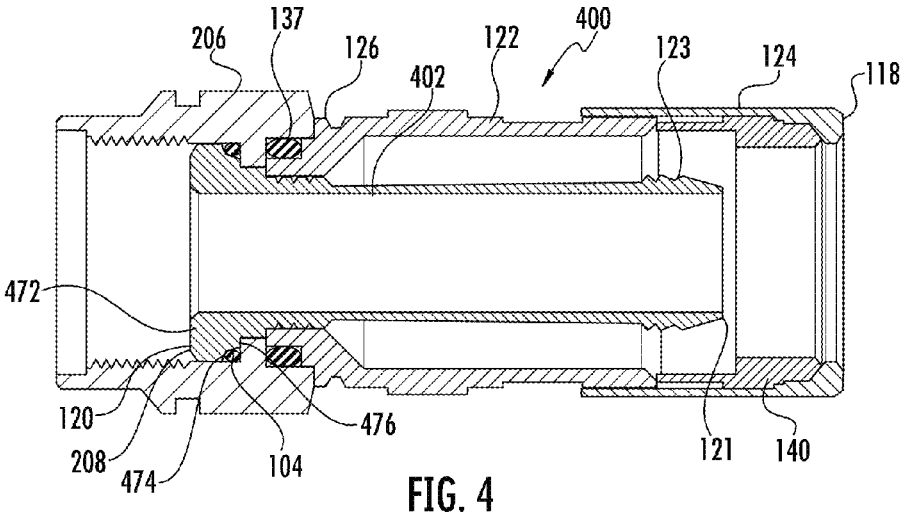
FIG. 4 is a cross-sectional view of an exemplary embodiment of a coaxial connector comprising a post having a tapered portion between a first radial face and a second radial face, a grounding member and a coupler.

FIG. 4 illustrates coaxial cable connector 400. Wherever possible, the same numbers for the same components as used for coaxial cable connector 100, will be used to describe coaxial cable connector 400. Additionally, components with the same or similar function as in coaxial cable connector 100 may not be described again with respect to coaxial cable connector 400. In at least one aspect, coaxial cable connector 400 differs from coaxial cable connector 100 in that coaxial cable connector 400 comprises a post 402 having tapered portion 472 between a first radial face 474 and a second radial face 476, grounding member 104, and coupler 206. Additionally, coupler 206 comprises straight bore 208. Coupler 206 is shown rotatably secured over end 120 of post 402 via a neck 126 of the body 122. Grounding member 104 may be disposed between post 402 and coupler 206 in structural feature in post 402 formed by tapered portion 472 and first radial face 474, as described in more detail with reference to FIG. 4A. The electrical grounding path is established by grounding member 104, which is resilient and electrically-conductive. In this way, the electrical grounding path may be maintained between coupler 206 and post 402, including, in particular, when the coupler 206 is not tightly fastened to the terminal.

Figure 4A:
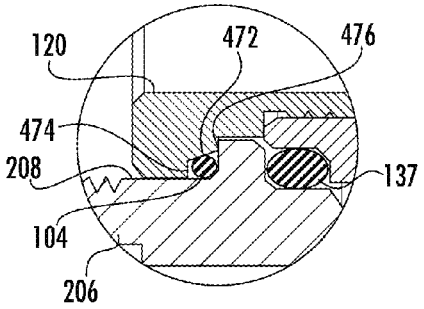
FIG. 4A is a detail, cross-sectional view of a portion of the coaxial connector of FIG. 4 illustrating the post, grounding member and coupler.

In this regard, as shown in FIG. 4A, grounding member 104 is disposed about tapered portion 472 and first radial face 474 proximate forward facing surface 134 of lip 132 and straight bore 208 of coupler 206, and is retained about the head 430 of the post 402 by tapered portion 472 and first radial face 474. In this way, grounding member 104 contacts both tapered portion 472, first radial face 474, forward facing surface 134 and straight bore 208 providing for an electrically-conductive path between post 402 and coupler 206 without restricting rotation of the coupler 206 relative to post 402. Grounding member 104 may be a spring member, or circlip, disposed between coupler 206 and post 402. The spring action of the grounding member 104 serves to establish a ground path from coupler 206 to the tubular post 402 while allowing coupler 206 to rotate and establishes and maintains a ground path between the coupler 206 and the post 402, as is described in more detail with reference to FIGS. 1B and 1C, above.

Figure 5:
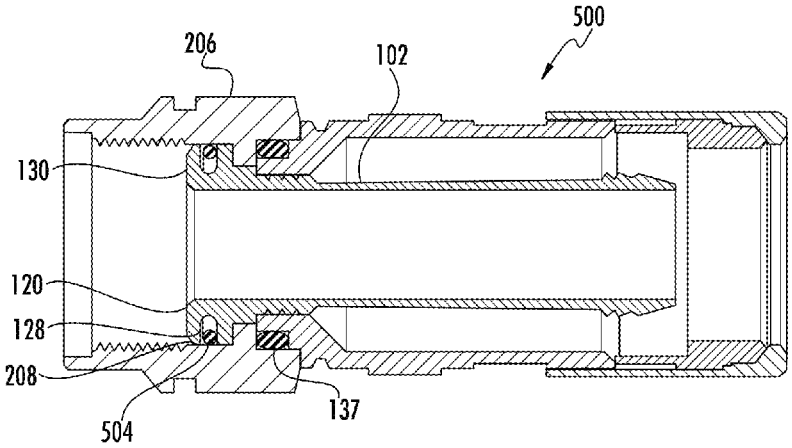
FIG. 5 is a cross-sectional view of an exemplary embodiment of a coaxial connector comprising a post, a coupler, and a grounding member having an overlapping structure with a circular cross-section.

FIG. 5 illustrates coaxial cable connector 500. Wherever possible, the same numbers for the same components as used for coaxial cable connector 100, will be used to describe coaxial cable connector 500. Additionally, components with the same or similar function as in coaxial cable connector 100 may not be described again with respect to coaxial cable connector 500. In at least one aspect, coaxial cable connector 500 differs from coaxial cable connector 100 in that coaxial cable connector 500 comprises grounding member 504 having an overlapping structure (more than 360 degrees) with a circular cross-section. Additionally, coupler 206 comprises a straight bore 208. The electrical grounding path is provided by a resilient, electrically-conductive grounding member 504 disposed between post 102 and coupler 206 and without restricting rotation of coupler 206 relative to post 102.

Figure 5A:
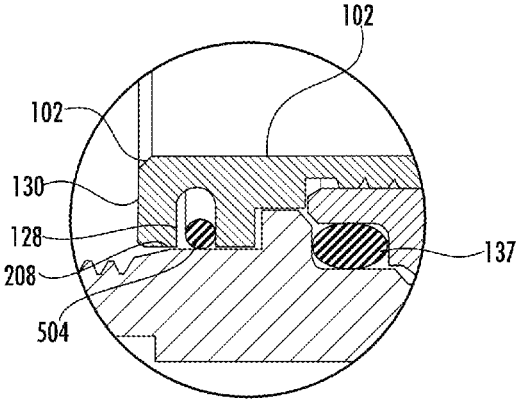
FIG. 5A is a detail, cross-sectional view of a portion of the coaxial connector of FIG. 5 illustrating the post, grounding member and coupler.

Referring now to FIG. 5A, similar to the embodiment illustrated in FIG. IA, structural feature in post 102 is an annular groove 128. Grounding member 504 may be disposed about and retained by annular groove 128 in post 102 proximate straight bore 208 and about head 130 of the post 102. In this way, grounding member 504 may be retained about the head 130 of the post 102 by annular groove 128 in the post 102. Annular groove 128 in post 102 as shown in FIG. 5A is "deeper" than annular groove 128 shown in FIG. IA. This is to accommodate the overlapping structure of grounding member 504. In this manner, grounding member 504 may contact a larger portion of the vertical walls of annular groove 128 in post 102 as compared to the embodiment illustrated in FIG. IA. Grounding member 504 may be a spring member, or circlip, as described in more detail with reference to FIG. 5B and may be resilient and biased toward coupler 206, such that grounding member 504 contacts both post 102 and coupler 206 at straight bore 208. The spring action of the grounding member 504 serves to form a ground path from the coupler 206 to post 102 while allowing the coupler 206 to rotate. In this way, grounding member 504 establishes an electrically-conductive, stable ground path between coupler 206 and post 102 without restricting rotation of coupler 206 relative to post 102.

Figure 5B:
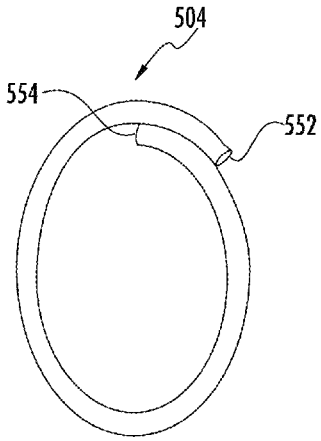
FIG. 5B is a detail, perspective view of the continuity member of the coaxial connector of FIG. 5.

In this regard, as shown in FIG. 5B, grounding member 504 may be a spring member, or circlip, having an overlapping structure (more than 360 degrees) with a circular cross-section. Grounding member 504 may be resilient and is generally arcuately shaped extending over an arc of at least 360 degrees and may have first end 552 and second end 554. Grounding member 504 may be constructed of a wire-type material and arcuately shaped in the form of a generally circular or non-circular broken ring, by bending a strip of metal wire into an arc. Grounding member 504 may be made of stainless steel wire that has a wire diameter of between 0.010-inch and 0.020-inch, such as a diameter of about 0.016-inch. Stainless steel may be used and, therefore, grounding member 504 may not be plated for corrosion resistance.

Figure 6:
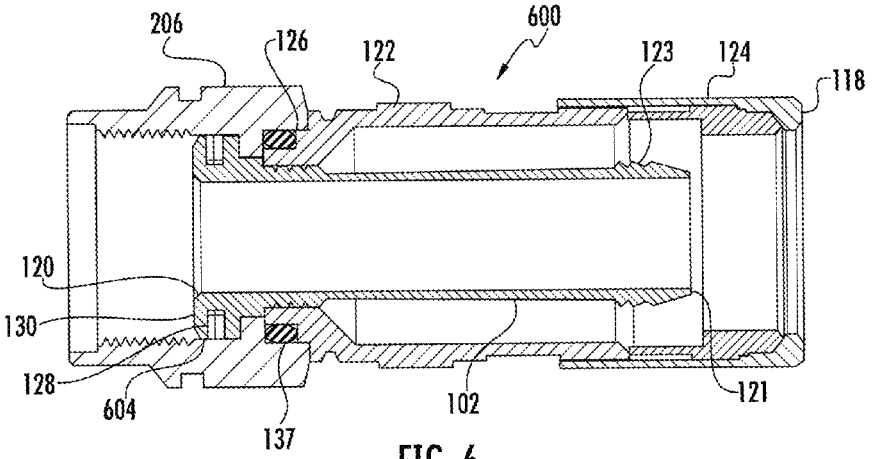
FIG. 6 is a cross-sectional view of an exemplary embodiment of a coaxial connector comprising a post, a coupler, and a grounding member having an overlapping structure with a flattened cross section and a coupler.

FIG. 6 illustrates coaxial cable connector 600. Wherever possible, the same numbers for the same components as used for coaxial cable connector 100, will be used to describe coaxial cable connector 600. Additionally, components with the same or similar function as in coaxial cable connector 100 may not be described again with respect to coaxial cable connector 600. In at least one aspect, coaxial cable connector 600 differs from coaxial cable connector 100 in that coaxial cable coaxial cable connector 600 comprises grounding member 604 having a flat generally circular structure. Additionally, coaxial cable connector 600 comprises coupler 206 having a straight bore 208. The electrical grounding path is provided by a resilient, electrically-conductive grounding member 604 disposed between post 102 and coupler 206.

Figure 6A:
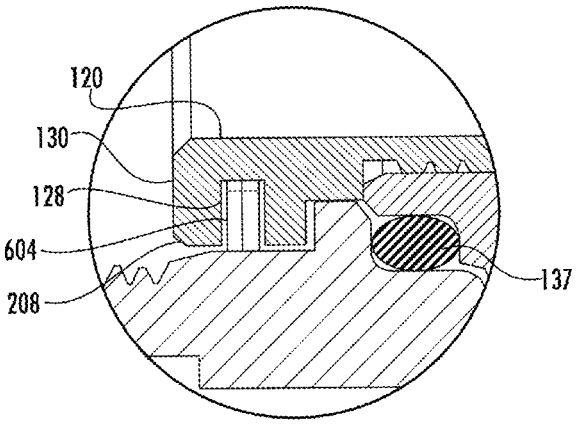
FIG. 6A is a detail, cross-sectional view of a portion of the coaxial connector of FIG. 6 illustrating the post, grounding member and coupler.

Referring now to FIG. 6A, similar to the embodiment illustrated in FIG. IA, structural feature in post 102 is an annular groove 128. Grounding member 604 is disposed about and retained by annular groove 128 in post 102 proximate straight bore 208 and about head 130 of the post 102. Annular groove 128 in post 102 as shown in FIG. 6A may be deeper than annular groove 128 shown in FIG. 1A to accommodate the overlapping structure of grounding member 604. In this way, grounding member 604 may contact a larger portion of the vertical walls of annular groove 128 in post 102 as compared to the embodiment illustrated in FIG. IA. Grounding member 604 may be a flat, circular structure having a spring action, as described in more detail with reference to FIG. 6B and may be resilient and biased toward coupler 206, thereby contacting both post 102 and coupler 206 at straight bore 208. In this way, grounding member 604 may establish and maintain an electrically-conductive, stable ground path between coupler 206 and post 102, including, in particular, when the coupler 206 is not tightly fastened to the terminal and without restricting rotation of coupler 206 relative to post 102.

Figure 6B:
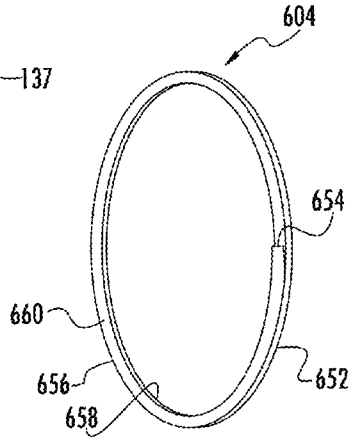
FIG. 6B is a perspective view of the continuity member of the coaxial connector of FIG. 6.

As shown in FIG. 6B, grounding member 604 has a flat, generally arcuate structure with first end 652 and second end 654, which may overlap. In other words, grounding member 604 may extend over an arc of at least 360 degrees or more. Grounding member 604 may have first edge 656, second edge 658 with width 660 therebetween. Width 660 may be about 0.035 inches. The arcuately shaped grounding member 604 may be in the form of a generally arcuate flat ring that may or may not be generally circular. Grounding member 604 may be made of stainless steel material that has a thickness of between 0.005-inch and 0.020-inch and, preferably, about 0.005-inch. Stainless steel may be used and grounding member 604 may not be plated for corrosion resistance.

Figure 7:
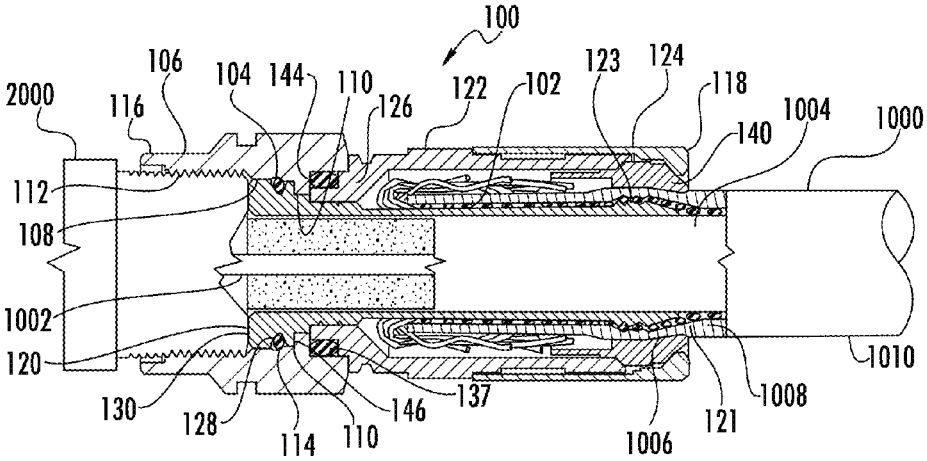
FIG. 7 is a cross-sectional view of the exemplary embodiment of coaxial cable connector of FIG. 1 with a cable fully inserted and the connector compressed to capture the cable. The connector of FIG. 1 is illustrated as attached to a terminal.

FIG. 7 is a cross-sectional view of coaxial cable connector 100 having a prepared coaxial cable 1000 inserted therein and attached to terminal 2000. Coaxial cable 1000 has a center conductor 1002 that is surrounded by a dielectric layer 1004. Dielectric layer (or dielectric) 1004 may also have a foil or other metallic covering 1006. Coaxial cable 1000 has a braided outer conductor 1008 which is covered and protected by a jacket 1010. Typically, to prepare coaxial cable 100 for attachment to connector 100, a portion of the center conductor 1002 is exposed. Jacket 1010 is trimmed back so that a portion of dielectric 1004 (and metallic covering 1006) and braided outer conductor 1008 are exposed. Braided outer conductor 1008 is then folded back over jacket 1010 to expose dielectric 1004 (and the metallic covering 1006 if present).

Coaxial cable 1000 inserts through second end 118 of body 122. In this way, body 122 and post 102 receive the coaxial cable 1000. Post 102 at back end 121 is inserted between outer conductor 1008 and dielectric layer 1004. Shell 124 is advanced toward coupler 106 forcing gripping member 140 between body 122 and jacket 1010, securing coaxial cable 1000 in coaxial cable connector 100. Additionally, post 102, and particularly barbs 123, establish contact with outer conductor 1008 providing for mechanical and electrical continuity between outer conductor 1008 and post 102, and, thereby, coaxial cable connector 100. In this way, electrical continuity, and accordingly a ground path and RFI shield, may be established and maintained from outer conductor 1008 of coaxial cable 1000 through post 102, body 122, grounding member 104, and coupler 106 to terminal 2000. It should be understood, that although FIG. 7 illustrates coaxial cable connector 100 with coaxial cable 1000 inserted therein and attached to terminal 2000, all coaxial cable connectors as set out herein, and modifications thereof, may be substituted for coaxial cable connector 100 in the embodiment illustrated in FIG. 7.

Many modifications and other embodiments set forth herein will come to mind to one skilled in the art to which the embodiments pertain having the benefit of the teachings presented in the foregoing descriptions and the associated drawings. Therefore, it is to be understood that the description and claims are not to be limited to the specific embodiments disclosed and that modifications and other embodiments are intended to be included within the scope of the appended claims.

It is intended that the embodiments cover the modifications and variations of the embodiments provided they come within the scope of the appended claims and their equivalents. Although specific terms are employed herein, they are used in a generic and descriptive sense only and not for purposes of limitation.

What is claimed is:

1. A coaxial cable connector for coupling an end of a coaxial cable to an equipment appliance port or terminal, the coaxial cable comprising an inner conductor, a dielectric surrounding the inner conductor, an outer conductor surrounding the dielectric, and a jacket surrounding the outer conductor is disclosed, the coaxial cable connector comprising:

a body;

a coupler rotatably attached to the body;

a post secured to the body, wherein the post has a structural feature; and a grounding member disposed in and retained by the structural feature, wherein the grounding member establishes an electrical grounding path between the post and the coupler, wherein the structural feature is a groove, the post comprises a head and the groove is an annular groove in a bottom surface of the head.

2. A coaxial cable connector for coupling an end of a coaxial cable to an equipment appliance port or terminal, the coaxial cable comprising an inner conductor, a dielectric surrounding the inner conductor, an outer conductor surrounding the dielectric, and a jacket surrounding the outer conductor is disclosed, the coaxial cable connector comprising:

a body;

a coupler rotatably attached to the body;

a post secured to the body, wherein the post has a structural feature; and a grounding member disposed in and retained by the structural feature, wherein the grounding member establishes an electrical grounding path between the post and the coupler, wherein the electrical grounding path is maintained between the post and the coupler when the coupler is not tightly fastened to a terminal.

3. The coaxial cable connector of claim 2, wherein the post comprises a head, and wherein the groove is a circumferential groove in a rearward facing surface of the head.

4. The coaxial cable connector of claim 2, wherein the structural feature is formed by a tapered portion and a first radial face of the post.

5. The coaxial cable connector of claim 1, wherein the grounding member is resilient and biased toward coupler.

6. The coaxial cable connector of claim 1, wherein the grounding member has at least a partial helical structure.

7. The coaxial cable connector of claim 1, wherein the grounding member has an arcuate shape.

8. The coaxial cable connector of claim 7, wherein the grounding member is generally circular.

9. The coaxial cable connector of claim 7, wherein the grounding member is generally non-circular.

10. The coaxial cable connector of claim 7, wherein the grounding member has a flat generally circular structure.

11. The coaxial cable connector of claim 7, wherein the grounding member extends over an arc of at least 225 degrees.

12. The coaxial cable connector of claim 11, wherein the grounding member extends over an arc of at least 360 degrees.

13. The coaxial cable connector of claim 12, wherein the grounding member extends over an arc of more than 360 degrees.

14. The coaxial cable connector of claim 1, wherein the grounding member has a first end and a second end.

15. The coaxial cable connector of claim 2, wherein the grounding member comprises, a ring, and a cantilevered annular beam extending from the ring.

16. The coaxial cable connector of claim 15, wherein the ring has a central aperture.

17. The coaxial cable connector of claim 15, wherein the ring has a first edge and a second edge.

18. The coaxial cable connector of claim 17, wherein the ring has a width between the first edge and the second edge.

19. The coaxial cable connector of claim 15, wherein the cantilevered annular beam comprises a plurality of cantilevered annular beams.

20. A coaxial cable connector for coupling an end of a coaxial cable to an equipment appliance port or terminal, the coaxial cable comprising an inner conductor, a dielectric surrounding the inner conductor, an outer conductor surrounding the dielectric, and a jacket surrounding the outer conductor is disclosed, the coaxial cable connector comprising:

a body;

a coupler rotatably attached to the body, the coupler having a lip with a forward facing surface;

a post secured to the body, wherein the post comprises a first end, a head, a neck, and a second end, and wherein the post has a structural feature; and a grounding member having an arcuate shape and disposed in and retained by the structural feature between the post and the coupler, wherein the grounding member is resilient and biased toward coupler, and wherein the grounding member establishes an electrical grounding path between the post and the coupler, and wherein the electrical grounding path is maintained between the post and the coupler when the coupler is not tightly fastened to a terminal.

21. The coaxial cable connector of claim 20, wherein the structural feature is a groove in the post.

22. The coaxial cable connector of claim 20, wherein the structural feature is formed by a tapered portion and a first radial face of the post.

23. The coaxial cable connector of claim 20, wherein the grounding member comprises, a ring having a central aperture, and a plurality of cantilevered annular beams extending from the ring.

24. The coaxial cable connector of claim 23, wherein the ring has a first edge, a second edge and a width between the first edge and the second edge.

25. The coaxial cable connector of claim 23, wherein the ring positions about the neck of the post such that the neck fits into the central aperture.

26. The coaxial cable connector of claim 23, wherein at least one of the plurality of cantilevered contacts the forward facing surface of the lip.

27. The coaxial cable connector of claim 20, wherein the structural feature is an annular groove in the bottom surface of the head.

28. The coaxial cable connector of claim 27, wherein the grounding member contacts the post and a tapered transition surface of the coupler.

29. The coaxial cable connector of claim 27, wherein the grounding member contacts the post and a straight bore of the coupler.

30. The coaxial cable connector of claim 20, wherein the grounding member extends over an arc of at least 225 degrees.

31. The coaxial cable connector of claim 20, wherein the grounding member extends over an arc of at least 360 degrees with overlapping first and second ends.

32. The coaxial cable connector of claim 20, wherein the grounding member comprises a circular cross-section.

33. The coaxial cable connector of claim 20, wherein the grounding member comprises a first end and a second end radially offset from the first end.

34. The coaxial cable connector of claim 20, wherein the grounding member comprises a flat generally arcuate structure comprising a first edge, a second edge and a width between the first and second edges.

35. The coaxial cable connector of claim 20, wherein the structural feature comprises a circumferential groove in the post formed in rearward facing surface of the head of the post.

36. The coaxial cable connector of claim 35, wherein the grounding member comprises a ring extending into the circumferential groove formed in the post and at least one annular beam extending from the ring and contacting the forward facing surface of the lip of the coupler.

37. The coaxial cable connector of claim 22, wherein the grounding member contacts the tapered portion and the first radial face of the post and the forward facing surface of the lip and a straight bore of the coupler.

* * * * *